US007658168B2

(12) United States Patent
Huettlin

(10) Patent No.: US 7,658,168 B2
(45) Date of Patent: Feb. 9, 2010

(54) OSCILLATING PISTON MACHINE

(76) Inventor: Herbert Huettlin, Ruemminger Strasse 15, Loerrach (DE) D-79539

( * ) Notice: Subject to any disclaimer, the term of this patent is extended or adjusted under 35 U.S.C. 154(b) by 152 days.

(21) Appl. No.: 11/844,595

(22) Filed: Aug. 24, 2007

(65) Prior Publication Data

US 2008/0041225 A1 Feb. 21, 2008

Related U.S. Application Data

(63) Continuation of application No. PCT/EP2005/013254, filed on Dec. 9, 2005.

(30) Foreign Application Priority Data

Feb. 25, 2005 (DE) ..... 10 2005 010 775
May 24, 2005 (DE) ..... 10 2005 024 751

(51) Int. Cl.
*F01C 1/02* (2006.01)

(52) U.S. Cl. ..... 123/18 R; 123/241; 123/245

(58) Field of Classification Search ..... 123/241, 123/245, 18 R; 418/35–38
See application file for complete search history.

(56) References Cited

U.S. PATENT DOCUMENTS 2,501,998 A 3/1950 Dutrey ..... 103/117
3,075,506 A 1/1963 Berry ..... 133/43
7,258,082 B2 * 8/2007 Huettlin ..... 123/241
2009/0031979 A1 * 2/2009 Huettlin ..... 123/18 A
2009/0038581 A1 * 2/2009 Huettlin ..... 123/245

FOREIGN PATENT DOCUMENTS

FR 2322282 3/1977
WO WO 03/067033 8/2003
WO WO 2005/098202 10/2005

OTHER PUBLICATIONS

International Preliminary Report on Patentability, PCT/EP2005/013254, Sep. 11, 2007, 6 pages.
International Search Report, Mar. 17, 2006, 3 pages.

* cited by examiner

*Primary Examiner*—Thomas E Denion
*Assistant Examiner*—Mary A Davis
(74) *Attorney, Agent, or Firm*—St. Onge Steward Johnston & Reens LLC

(57) ABSTRACT

An oscillating piston machine comprises a housing in which a first and at least a second piston are arranged, which pistons can rotate together in the housing about a rotational axis which is fixed to the housing and which pistons, as they rotate about the rotational axis, carry out reciprocating oscillating movements in opposite directions to one another about an oscillation axis which extends perpendicularly to the rotational axis and through the center of the housing, wherein the first piston has a first end face and the at least second piston has a second end face which faces the first end face, wherein the end faces bound a working chamber. The pistons are arranged in such a way that the rotational axis extends through the working chamber.

12 Claims, 29 Drawing Sheets

Minimum stroke (minimum volume of working chambers 260,262)

Maximum stroke (maximum volume of working chambers 260,262)

Control cam

90° Interlacing

Simultaneous events (working strokes)

I = Intake II = Compression III = Work IV = Exhaust

OSCILLATING PISTON MACHINE

This is a continuation of the International Application PCT/EP2005/013254, with an international filing date of Dec. 9, 2005.

The invention relates to an oscillating piston machine, comprising a housing in which a first and at least a second piston are arranged, which pistons can rotate together in the housing about a rotational axis which is fixed to the housing and which pistons, as they rotate about the rotational axis, carry out reciprocating oscillating movements in opposite directions to one another about an oscillation axis which extends perpendicularly to the rotational axis and through the centre of the housing, wherein the first piston has a first end face and the at least second piston has a second end face which faces the first end face, wherein the end faces bound a working chamber.

Such an oscillating piston machine is known from document WO 03/067033 A1.

Oscillating piston machines, and in particular an oscillating piston machine according to the present invention, can be used as internal combustion engines, as pumps or as compressors. An oscillating piston machine according to the present invention is preferably used as an internal combustion engine and is described as such in the present description.

If an oscillating piston machine is used as an internal combustion engine, the individual working strokes of intake, compression, ignition of the combustion mix and expansion and exhaust of the burnt combustion mix are produced by reciprocating oscillating movements of the individual pistons between two limit positions.

In the case of the oscillating piston machine which is known from document WO 03/067033 A1 in the name of the same applicant, four pistons are arranged in the housing, and these pistons rotate jointly about a rotational axis which is arranged fixedly in the centre of the housing, and as they rotate they execute reciprocating oscillating movements about an oscillation axis in the housing, with in each case two adjacent pistons oscillating in opposite directions. In this known oscillating piston machine, two pistons which are in each case arranged diametrically opposite one another with respect to the centre of the housing are rigidly connected to one another to form a double piston, and two piston pairs of this type are in a crossed-over arrangement in the centre of the housing. In each case one working chamber is formed between in each case two end faces of the piston of the piston pairs facing one another, so that the known oscillating piston machine has two working chambers. The size of the two working chambers which are arranged diametrically opposite with respect to the centre of the housing increases and decreases in the same direction with the reciprocating oscillating movement of the pistons.

The pistons of this known oscillating piston machine are arranged in such a way in the housing that in their TDC (Top Dead Center) position, in which the volumes of the two working chambers are at a minimum, they are positioned perpendicular to the rotational axis. In this position, the centrifugal forces acting on the pistons during the rotation of the pistons about the rotational axis are at a maximum. The result of this is that at high rotational speeds the expansion or the oscillation of the pistons away from one another has to take place counter to the centrifugal forces, since the centrifugal forces counteract this movement of the pistons away from one another. In this oscillating piston machine, the working chambers are always located outside and perpendicular to the rotational axis.

The pistons of the known oscillating piston machine are substantially in the form of a wedge of a sphere, and correspondingly so is the geometry of the working chambers.

Although the known oscillating piston machine has very good operating properties, the present invention is aimed at providing a new concept for an oscillating piston machine which differs from the concept of the known oscillating piston machine described above.

The invention is therefore based on the object of specifying such a new concept for an oscillating piston machine of the type mentioned at the beginning.

According to the invention, this object is achieved on the basis of the oscillating piston machine mentioned at the beginning by virtue of the fact that the pistons are arranged in such a way that the rotational axis extends through the working chamber.

The new concept of the oscillating piston machine according to the invention compared to the known oscillating piston machine accordingly consists in the fact that the at least two pistons are arranged in such a way that the at least one working chamber is not located perpendicular to the rotational axis but rather on the rotational axis or around the rotational axis. The centrifugal forces which, as they rotate about the rotational axis, act on the two pistons which bound the working chamber are smaller owing to the smaller distance of the pistons from the rotational axis and furthermore act in the direction in which the two pistons oscillate away from one another, i.e. the centrifugal forces assist the expansion working stroke. The centrifugal forces which occur perpendicular to the rotational axis as the pistons rotate about the rotational axis therefore assist the expansion of the at least one working chamber.

In one preferred configuration there is provision for the first and second end faces of the first and at least second piston to be of circular design.

In this configuration, the first and at least second pistons are cylindrical, at least in the region which adjoins their end faces, and they are therefore very similar to conventional pistons of linearly reciprocating piston engines in this region. One advantage which results from this is that piston rings, if appropriate with a corresponding curvature, can be used as seals for the two pistons, so that in this respect it is possible to make use of longstanding experience in solving sealing problems in reciprocating piston engines. In this configuration, the working chamber bounded by the two end faces of the first and at least second piston has the geometry of a cylinder or toroidal section curved about the oscillation axis.

However, as an alternative to a circular configuration of the end faces of the first and at least second pistons, it is also possible to select a different geometry, for example an oval shape, which contributes to increasing the size of the at least one working chamber in particular if the interior of the housing is spherical-symmetrical.

In a further preferred configuration, the first and the at least second pistons are of essentially arcuate design.

It will be understood that the arcuate configuration of the first and at least second pistons may be restricted to the region adjoining their end faces, i.e., as will be described in more detail below, outer sides of the pistons which are remote from the end faces may be used as functional elements for controlling the pistons in order to derive the oscillating movement from the rotating movement of the pistons, and for this purpose may be configured in different ways.

In a further preferred configuration, the first piston and/or the at least second piston have at least one running member which, as the first and/or at least second piston rotates, is guided along a correspondingly designed control cam in order to generate the oscillating movements of the first and at least second piston, wherein the control cam is arranged on the housing at an at least approximately maximum distance from the rotational axis.

In the known oscillating piston machine, there is a comparable control mechanism for controlling the oscillating movements of the pistons, but in that case the control cam is at a shorter distance from the rotational axis, in the vicinity of the end sides of the housing. The advantage of the greater distance between the control cam and the rotational axis consists in improved lever ratios, in order to derive the oscillating movements of the at least two pistons from their rotating movement about the rotational axis.

In this context, it is also preferable if the at least one running member is a ball which is rotatably mounted in a ball socket on an outer side, facing the housing, of the first and/or at least second piston, and if the control cam is embodied as a groove with a pitch-circle-shaped cross section in the housing, into which groove the ball partially engages.

A control mechanism of this type, which uses a ball as the at least one running member, has the advantage of optimum reduction in friction in the control mechanism, since the ball can rotate freely in the ball socket of the at least one piston, and also in the groove in the housing, so that the ball can follow the control cam with particularly little friction, on account of the fact that it can rotate in all directions.

The ball socket may be designed in such a way that it holds the ball captively, or the ball can be held in the ball socket by adhesion forces by means of a lubricating film which is provided by oil lubrication.

It is preferable for both the first and the at least second piston to have a running member in the form of a ball, which balls run at a distance from one another in the same groove-like control cam in the housing.

As an alternative to configuring the at least one running member in the form of a ball, said member can be a roller whose running face is constructed in the form of part of a circle transversely with respect to the circumferential direction of the roller, wherein the roller is mounted on a shaft which is connected at the end side to the first or second piston. The control cam is again preferably embodied here as a groove with a pitch-circle-shaped cross section in the housing, into which groove the roller partially engages.

The advantage of configuring the at least one running member as a roller or guide roller with a shaft connection of the roller to the piston makes it possible for the oil adhesion of the ball to the piston which is necessary with the abovementioned ball which can freely rotate in all directions to be dispensed with. Nevertheless, the entire width of the piston guide surfaces is used. The mounting of the at least one roller on the shaft is preferably done by means of precision needle bearings, and the roller is in particular preferably connected to the piston in a detachable fashion.

In a further preferred configuration, the first and the at least second piston are mounted in a sliding fashion in a piston cage which is arranged in the housing concentrically with respect to the rotational axis so as to be rotatable about said rotational axis, wherein the piston cage is connected in a rotationally fixed fashion to the first and at least second piston with respect to the rotating movement about the rotational axis.

The piston cage and the first and at least second piston therefore form the "inner machine" or "inner motor" of the oscillating piston machine. The sliding mounting of the two pistons in the piston cage is used for the oscillating mobility of the two pistons about the oscillation axis, while on account of being connected in a rotationally fixed fashion to the piston cage in terms of the rotating movement about the rotational axis, the pistons rotate with the piston cage about the rotational axis. The piston cage can now advantageously be used as a drive or output member.

The piston cage is therefore preferably connected to at least one drive shaft and/or output shaft which extends parallel to the rotational axis.

This can preferably be implemented in such a way that the at least one drive shaft and/or output shaft is arranged concentrically with respect to the rotational axis and is connected in a rotationally fixed fashion to the piston cage.

This configuration has the advantage that the oscillating piston machine can be given an overall compact design since there is no offset between the rotational axis and the drive shaft and/or output shaft. Furthermore, there is no need for a transmission mechanism for transmitting the rotational movement of the piston cage to the drive shaft and/or output shaft, or vice versa.

However, alternatively to this, it is also preferred if the at least one drive shaft and/or output shaft is arranged at a lateral distance from the rotational axis and is connected to the piston cage by means of at least one transmission mechanism arrangement, for example a crown gear arrangement or belt drive arrangement.

The advantage of this measure is that the at least one drive shaft and/or output shaft is arranged with a lateral offset from the at least one working chamber, which, of course, lies on the rotational axis. This in turn prevents the spark plug or glow plug, which is to be provided for the at least one working chamber if the oscillating piston machine is used as an internal combustion engine, from colliding with the drive shaft and/or output shaft. With the measure mentioned above it is, in fact, necessary under certain circumstances for the spark plug or glow plug to be decoupled from the rotational movement of the piston cage and the associated drive shaft and/or output shaft, or for the plug itself to be allowed to rotate with the said shaft, which, however, requires electrical contact to be formed with the plug using sliding contacts.

With the measure mentioned above, the fuel injection nozzle and, if appropriate, inlet and outlet connection pieces may additionally also likewise be arranged on the end side of the housing. In this context it is possible for combined spark plug/injection nozzle arrangements to be provided.

In a further preferred configuration, the piston cage has, approximately perpendicularly with respect to the rotational axis, a bore in which the first and at least second pistons are held partially and so as to slide therein and which bounds the working chamber in the circumferential direction.

The bore therefore defines, together with the two end faces, which face one another, of the first and at least second piston, the at least one working chamber of the oscillating piston machine. The geometry of the bore in the piston cage is also selected according to the geometry of the end faces of the two pistons, i.e. for example to be circular or, as has already been mentioned above, oval or some other shape corresponding to the shape of the end faces of the pistons. If the end faces of the two pistons are circular in form, the result, in combination with the circular bore in the piston cage, is a working chamber which corresponds to a curved cylinder or a toroidal section. The pistons are then preferably sealed against the wall of the bore of the piston cage by means of seals, the latter, in the case of a circular bore and circular end faces, advantageously being designed as piston rings matched to the shape of the working chamber.

In a further preferred configuration, a duct passes through the piston cage, said duct opening at one end into the bore and at the other end opening in the direction of the housing in order to communicate with an inlet opening or an outlet opening in the housing depending on the rotational position.

The advantage of this measure is that the piston cage, by means of the abovementioned duct or opening, acts as a type of valve for the inlet and outlet openings in the housing. It is therefore not necessary for the inlet and outlet openings in the housing to be provided with separate valves, or to provide a complex control of the valve for the instant of opening or closing, as is the case in conventional linearly reciprocating-piston engines. The opening and closing of the inlet and outlet openings to admit combustion air and/or fuel and to discharge burnt combustion mix take place automatically at the correct stroke as a result of the rotating movement of the piston cage about the rotational axis.

In a further preferred configuration, the piston cage has at least one duct for a medium, in particular cooling medium/lubricating medium, which extends at least partially over the circumference and through the interior of the piston cage.

One advantage of this arrangement is that the piston cage advantageously performs a further function, namely that of supplying all the moving parts within the housing with a cooling and/or lubricating medium. A cooling/lubricating medium can be supplied via connections arranged at the housing, in which case the at least one duct preferably extends as an annular duct on the outer side of the piston cage, so that the at least one duct is always in communication with the supply connections.

In a further preferred configuration, a bore which is preferably widened in the direction of its ends passes through the piston cage at the level of the oscillation axis, in the direction of said oscillation axis.

This bore advantageously serves as a further coolant/lubricant duct, which makes a contribution to particularly intensive circulation of a cooling/lubricating medium of this type, since this bore extends perpendicular to the rotational axis, and therefore the cooling/lubricating medium which is then located therein is subjected to centrifugal forces as the piston cage rotates about the rotational axis, causing the cooling/lubricating medium to move towards the widening ends of the bore. As a result, a ventilation effect advantageously occurs during the circulation of the cooling/lubricating medium.

In a further preferred configuration, a third and fourth piston are arranged in the housing, which pistons can oscillate about the same oscillation axis or an oscillation axis which is different therefrom, and can rotate with the first and second pistons about the rotational axis and define a second working chamber.

In this configuration, a system which is advantageously symmetrical, and therefore balanced in terms of mass, with respect to the rotational axis is also created in the oscillating piston machine according to the invention.

In this context it is preferred if the four pistons are arranged in such a way that as the pistons are rotated about the rotational axis, the first and second working chambers increase and decrease in size in the same sense.

This configuration contributes to making the four pistons constitute a mass-balanced system in every position of rotation and oscillation.

In one configuration of the oscillating piston machine with a total of four pistons, there is preferably provision, in a first configuration, for the first and second pistons and the third and fourth pistons to be arranged with respect to the rotational axis in such a way that the oscillating movements of all the pistons occur in the same plane.

In this configuration, the two working chambers always lie in the same plane in a section along the rotational axis and perpendicular to the oscillation axis.

It is even more preferred if the first and second pistons and the third and fourth pistons are arranged with respect to the rotational axis in such a way that the oscillating movements of the first and second pistons occur in a first plane, and the oscillating movements of the third and fourth pistons occur in a second plane, wherein the first and second planes are rotated relative to one another by an angle which is unequal to 0° with respect to the rotational axis.

In this configuration, the two working chambers which are formed by the four pistons do not correspondingly lie in a common plane as in the previously mentioned configuration but rather are offset in relation to one another with respect to the rotational axis by an angle which is unequal to 0°. This then has the advantage over the previously mentioned configuration that the above-mentioned control cam, or in the case of four pistons two control cams and the running members which are guided therein and which are preferably embodied as balls, do not have to have their end point in or before the orthogonal to the rotational axis but rather can extend beyond the orthogonal since, owing to the offset of the two piston pairs with respect to one another, the running members cannot collide with one another in the BDC (Bottom Dead Center) position, i.e. when the working chambers are opened to a maximum extent, since the piston pairs are arranged rotated with respect to one another by an angle which is unequal to 0°. In this way it is possible, compared to the previously mentioned configuration, to enlarge the maximum volume of the two working chambers (BDC position of the pistons) owing to a relatively large angle of aperture of the two piston pairs. As in one of the abovementioned configurations, it is preferred if the two working chambers also increase and decrease in size in the same sense in this variant, which is achieved by corresponding shaping of the control cams.

It is particularly preferred if the angle is at least approximately 90° within the scope of the previously mentioned configuration.

With this configuration, again the greatest possible degree of symmetry of the mass distribution of the pistons in the housing is achieved.

In a further preferred configuration, the piston cage extends on either side of the oscillation axis or oscillation axes and also accommodates the third and fourth pistons.

Overall, therefore, this creates a particularly simple structure, requiring only a small number of parts, in which the piston cage accommodates all four pistons. For the third and fourth pistons, the piston cage, if this is provided for the first and second pistons as described above, likewise has a bore, in which bore the third and fourth pistons are mounted slideably and are connected in a rotationally fixed fashion to the piston cage with respect to the rotational axis, this bore, together with the end faces of the third and fourth pistons, then bounding the second working chamber.

In a further preferred configuration, a housing inner wall of the housing is essentially spherical.

This configuration advantageously creates a spherical-symmetrical oscillating piston machine, which has already proven its worth in the known oscillating piston machine.

As an alternative, however, it can also be provided that a housing inner wall of the housing is oblong in section in the direction of the rotational axis along a plane which includes the rotational axis.

In this context, the term "oblong" is to be understood as meaning that the housing of the oscillating piston machine comprises two halves of a sphere, between which is inserted a portion which is elongate in the direction of the rotational axis. The oblong shape of the housing inner wall of the housing advantageously opens up the possibility of providing the following preferred configurations.

For example, it is preferable if a hollow pin, which can oscillate about the oscillation axis, and which has, in its wall, an opening which communicates with the first working chamber or, if appropriate, with the second working chamber as a function of the rotary position of the hollow pin, is arranged in the housing.

This hollow pin can advantageously be used to feed fresh air, in particular pressurized fresh air, into the working chamber or, if two working chambers are provided, into the two working chambers alternately, via the circumferentially bounded opening provided in the hollow pin. As a result, combustion air can be passed into the working chambers at an admission pressure, making it possible to achieve greater compression of the fuel-air mix in the working chambers. In this way, the oscillating piston machine is suitable in particular as a diesel engine.

In this context, it is preferable if the hollow pin is connected to a transmission mechanism which, when the pistons rotate about the rotational axis, causes the hollow pin to rotate about the oscillation axis.

In this way, the rotational movement of the hollow pin to enable its opening to communicate with one working chamber or the other is derived, in an advantageously simple way, directly from the rotating movement of the pistons about the rotational axis, without the need for an external control mechanism. If the step-up ratio of the transmission mechanism is selected appropriately, the rotational speed of the hollow pin is synchronized in a simple way with the rotational speed of the oscillating piston machine.

In this context, it is also preferable if the transmission mechanism has a worm toothing which is connected to the hollow pin and meshes with at least one toothing which is arranged on the housing and extends about the rotational axis.

A transmission mechanism of this type is of particularly simple design, can be accommodated in the housing without an increased need for space, and given a suitable configuration of the worm toothing the rotational speed of the hollow pin can then be adapted as a function of the rotational speed of the rotating movement of the pistons about the rotational axis.

Further advantages and features will emerge from the following description and the appended drawing.

It will be understood that the features which have been listed above and are yet to be explained below can be used not only in the combination given in each instance, but also in other combinations or as stand-alone measures without departing from the scope of the present invention.

Exemplary embodiments of the invention are illustrated in the drawing and are described in more detail below with reference to the drawing, in which.

Figure 16:
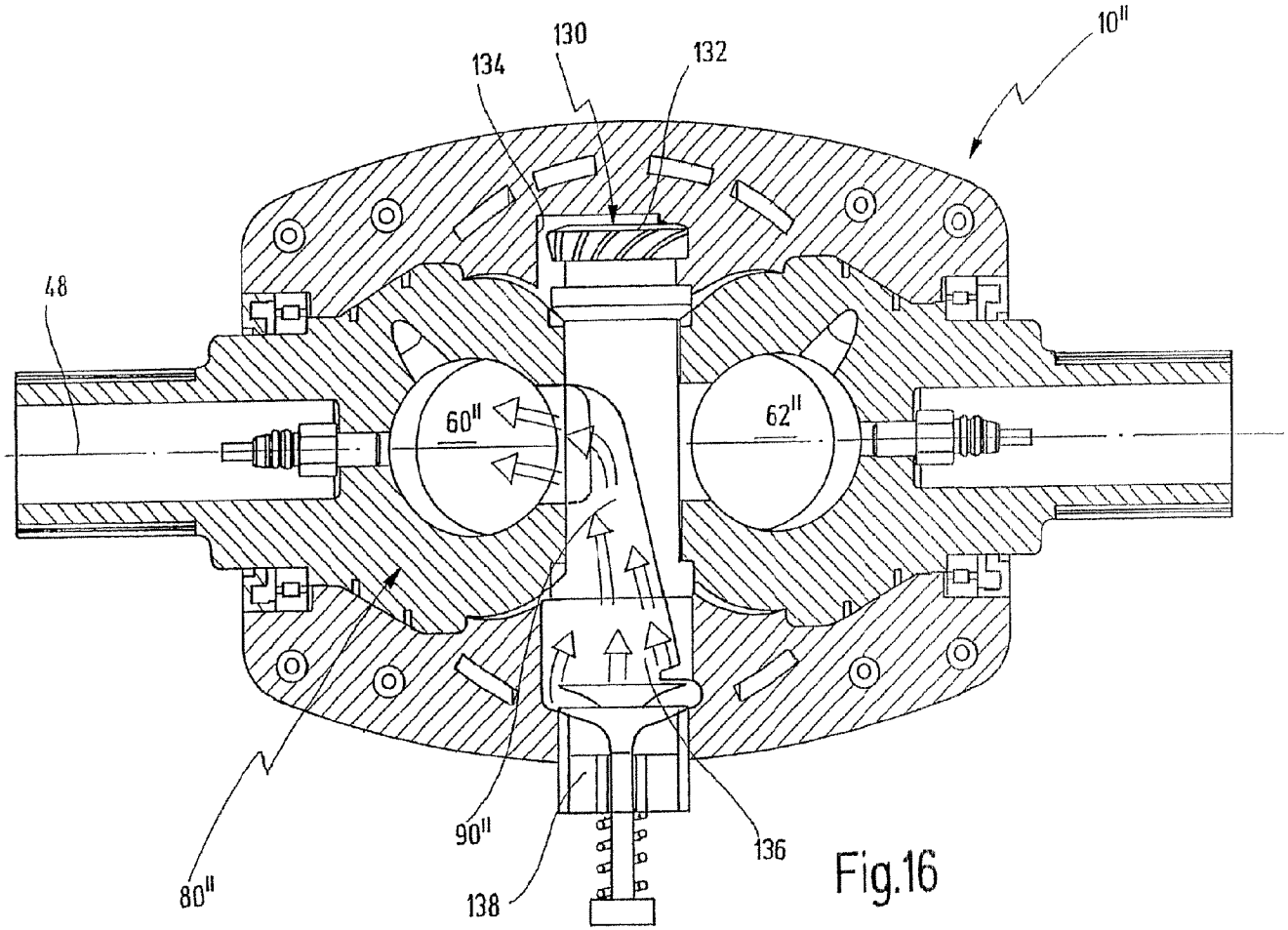
Figure 17:
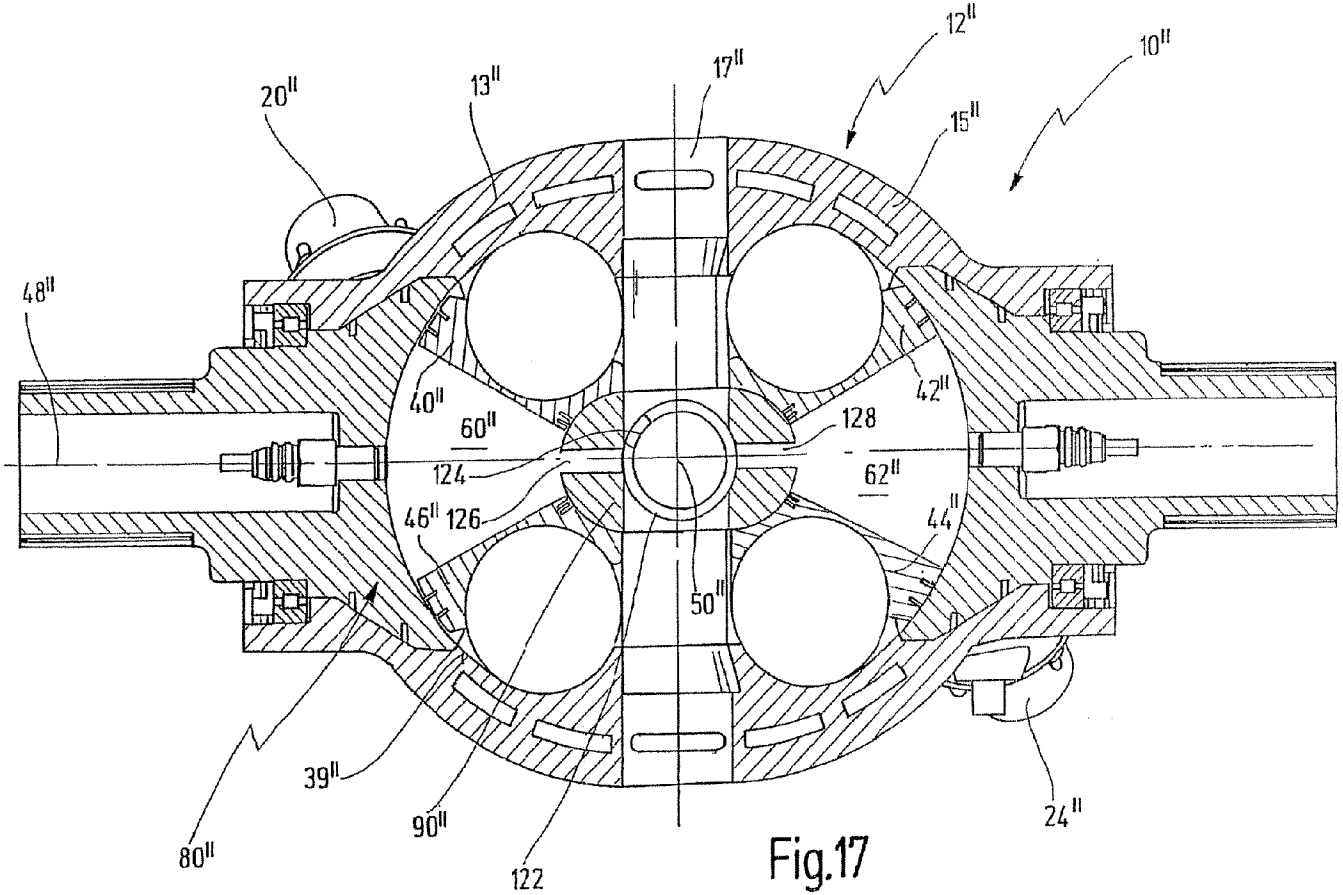
Figure 18:
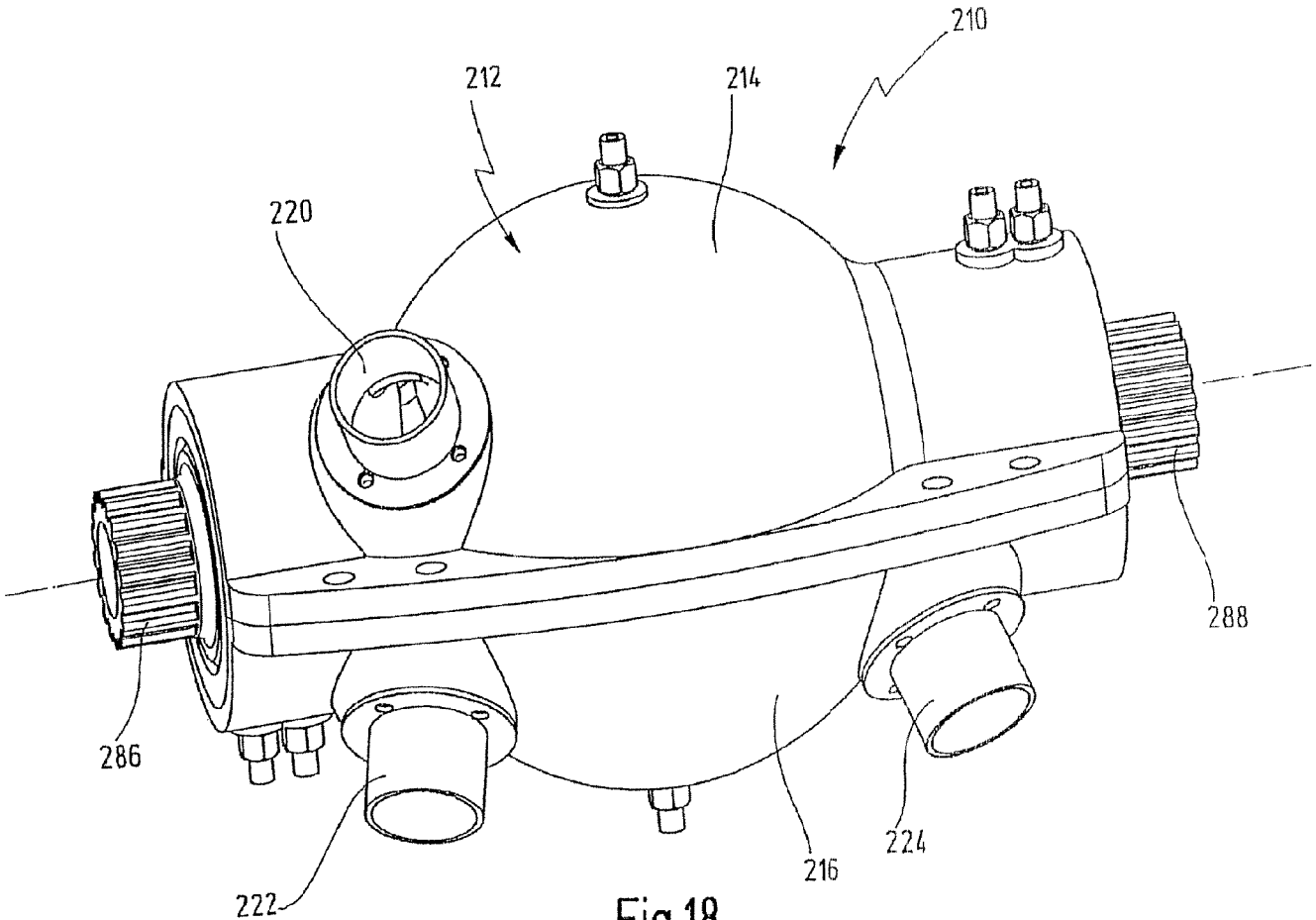
Figure 19:
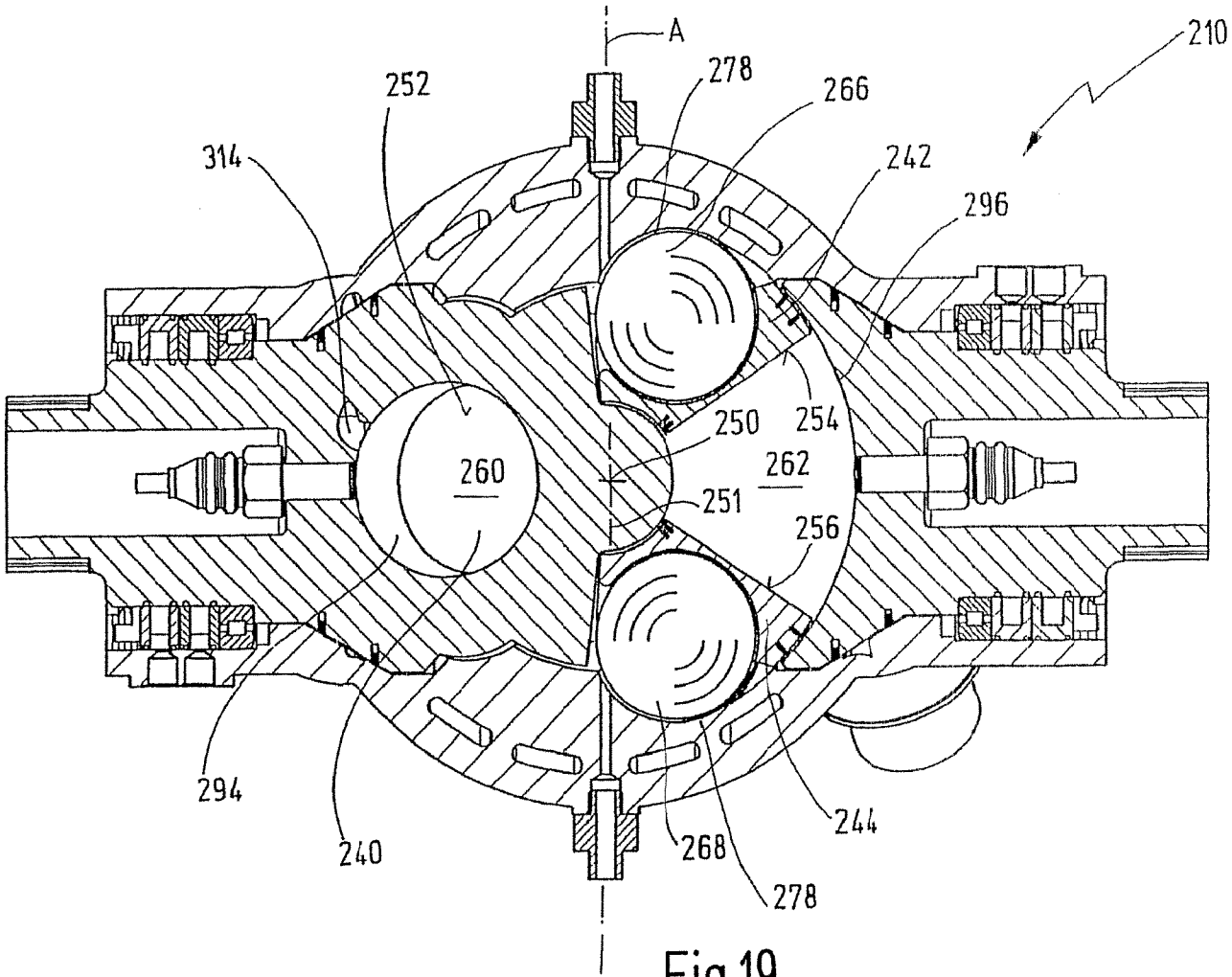
Figure 20:
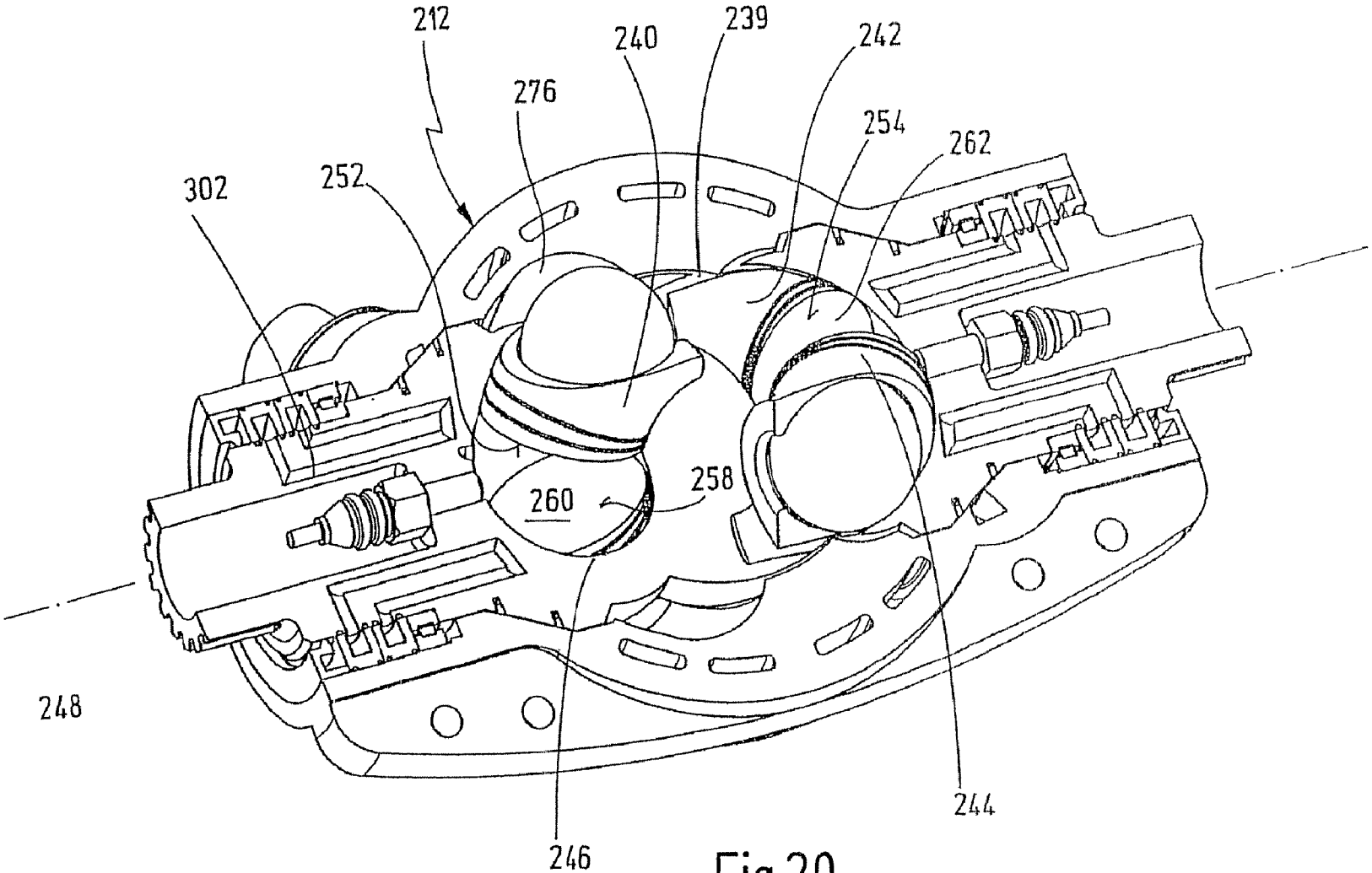
Figure 21:
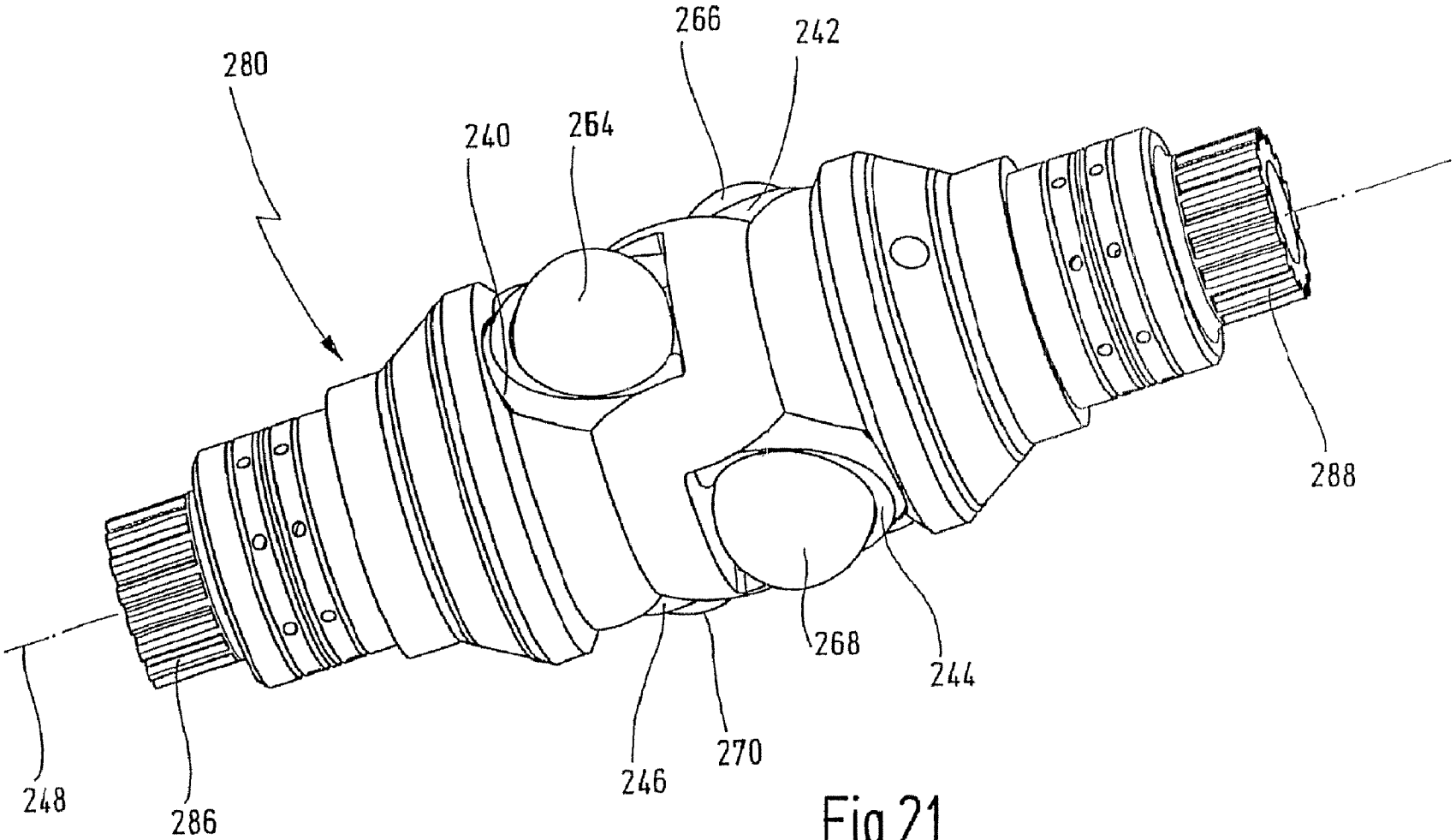
Figure 22:
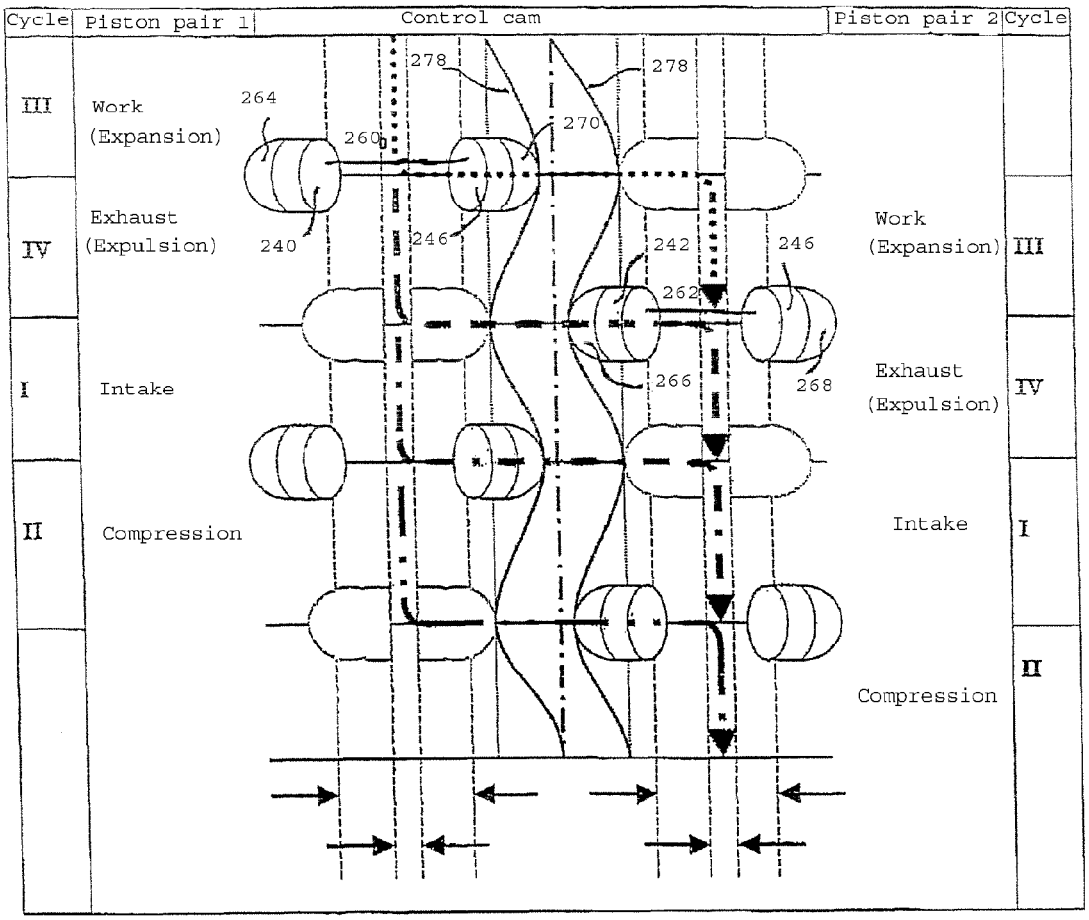
Figure 22:
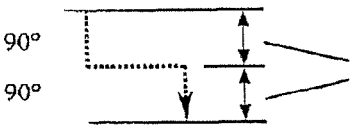
Figure 23:
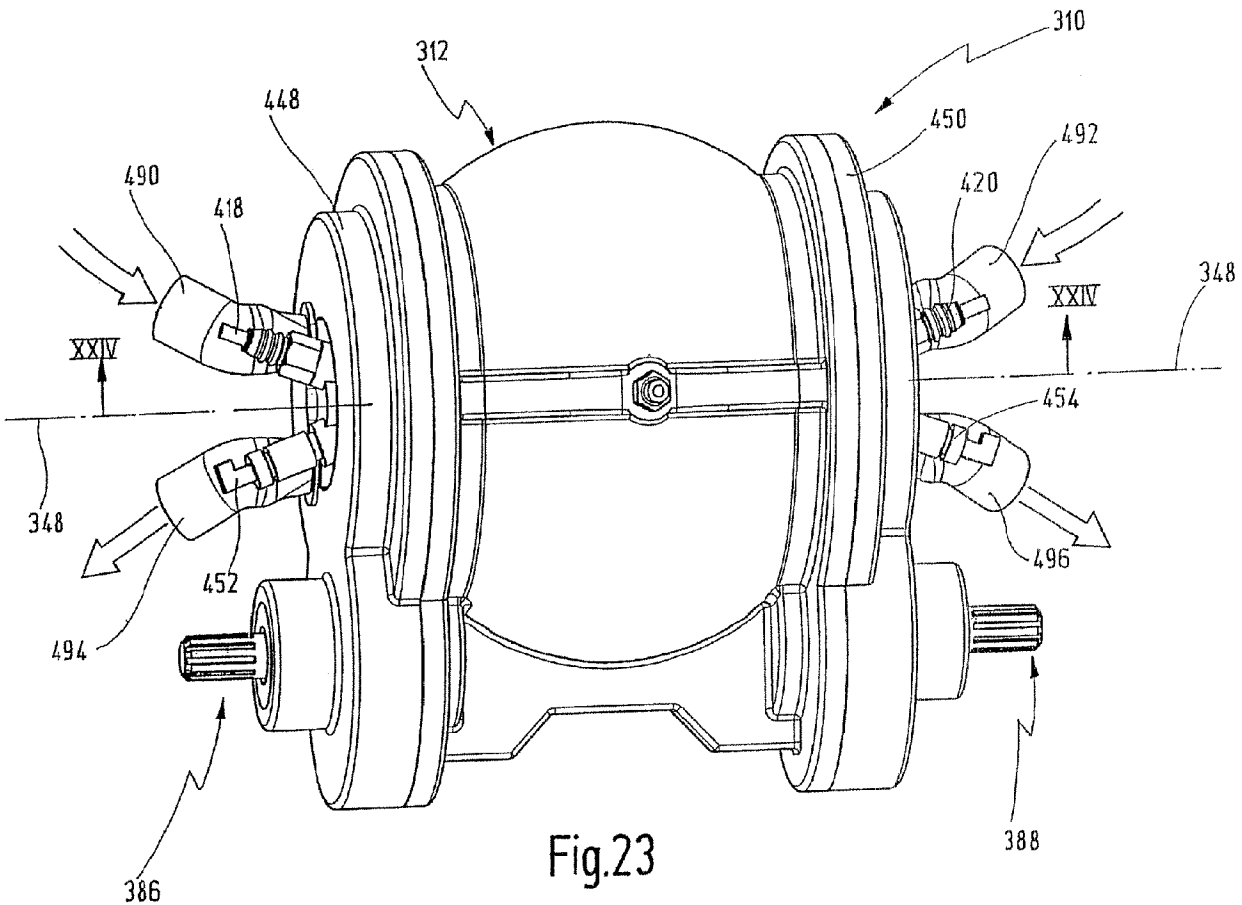
Figure 24:
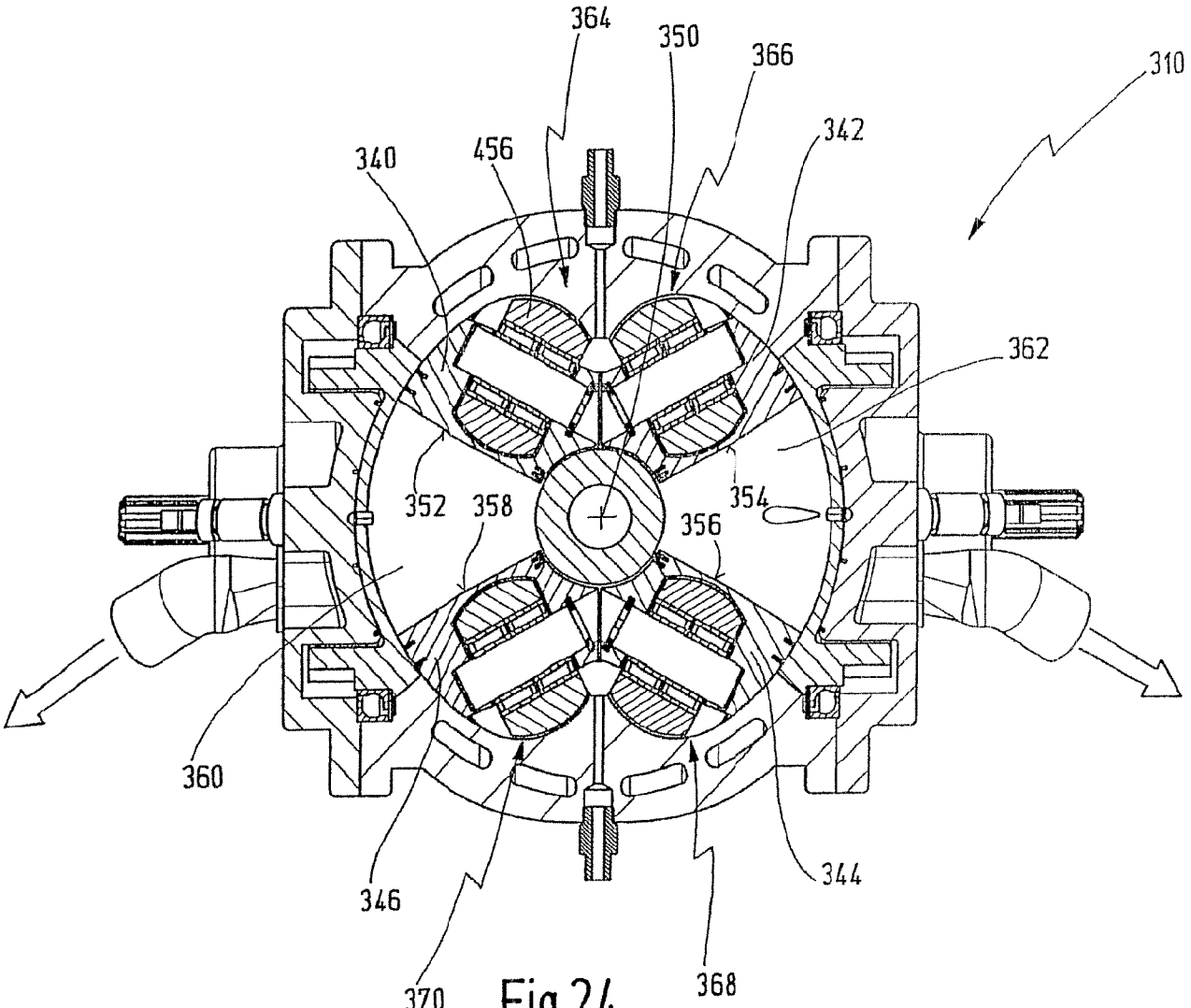
Figure 25:
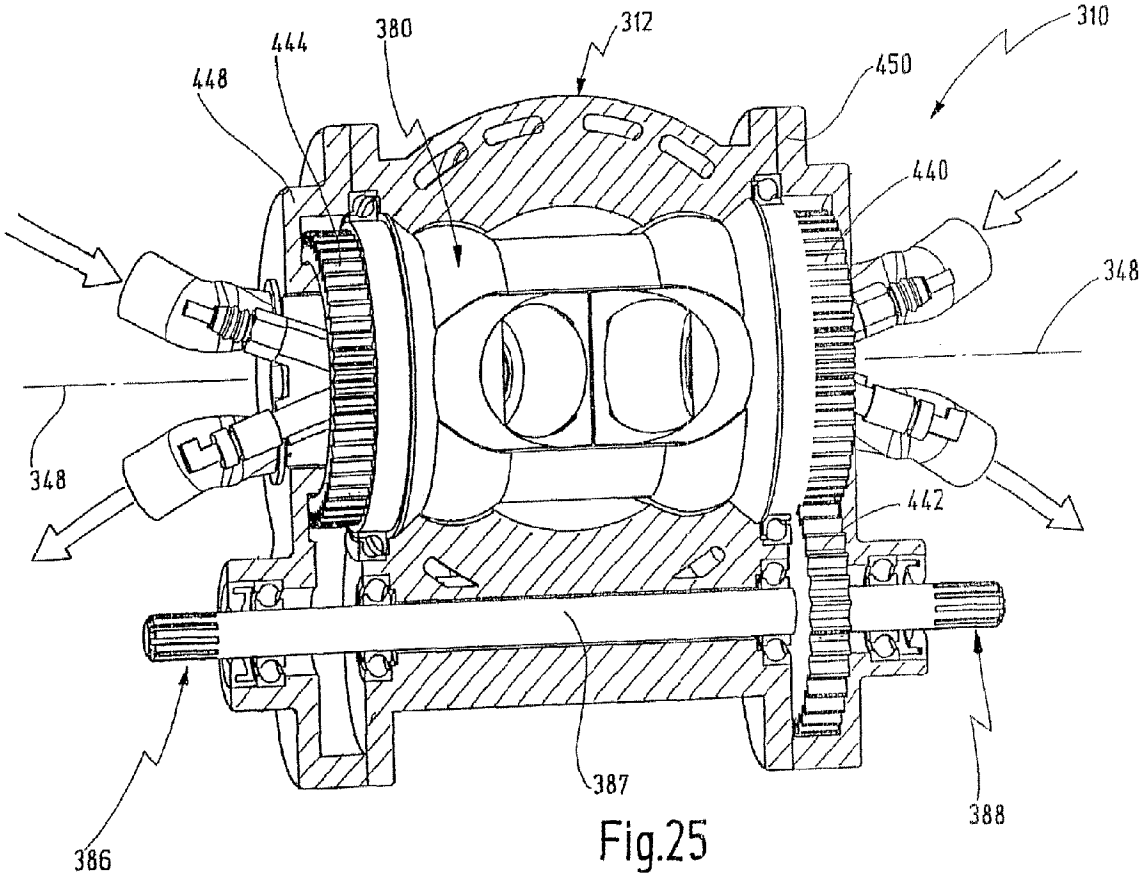
Figure 26:
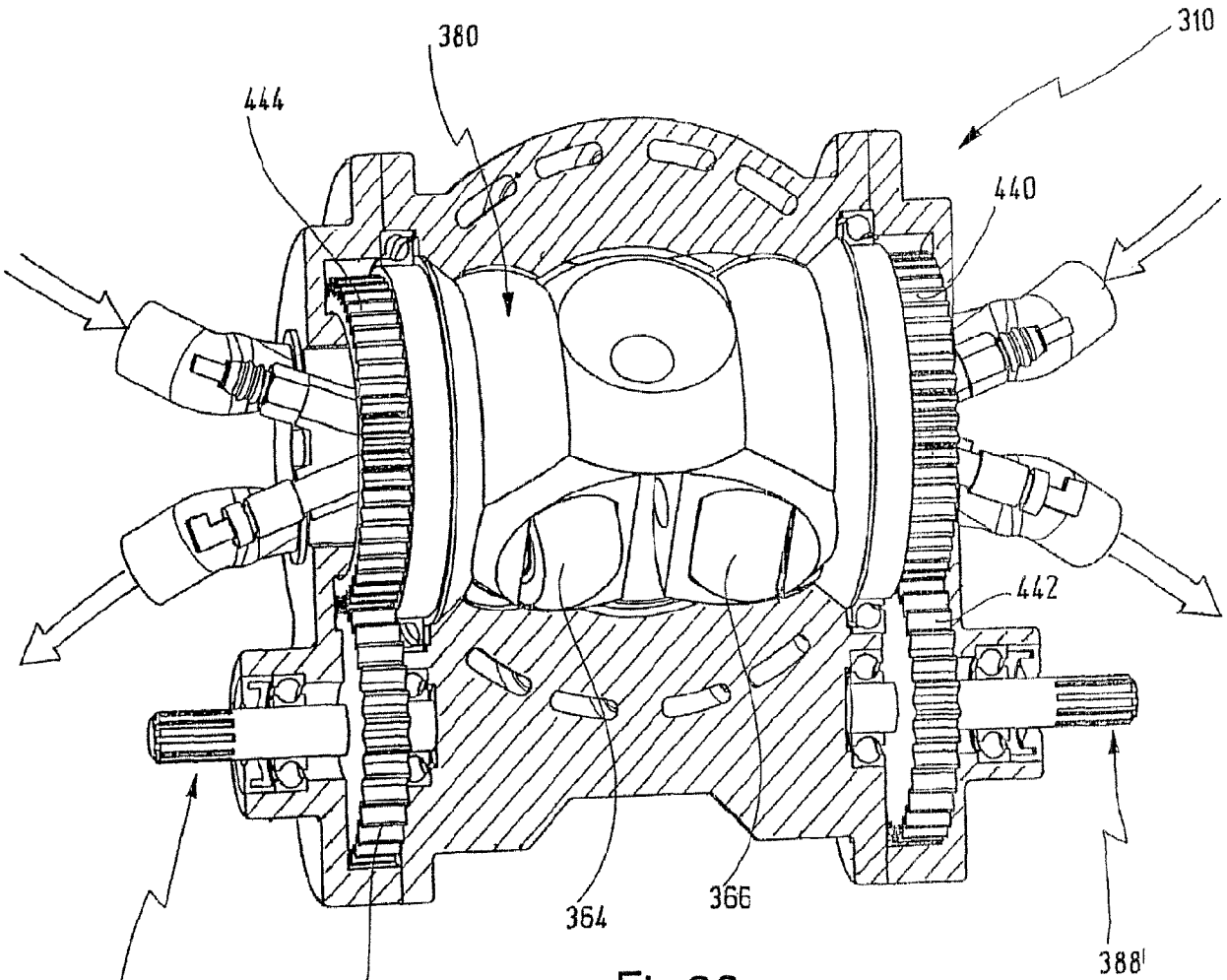
Figure 27:
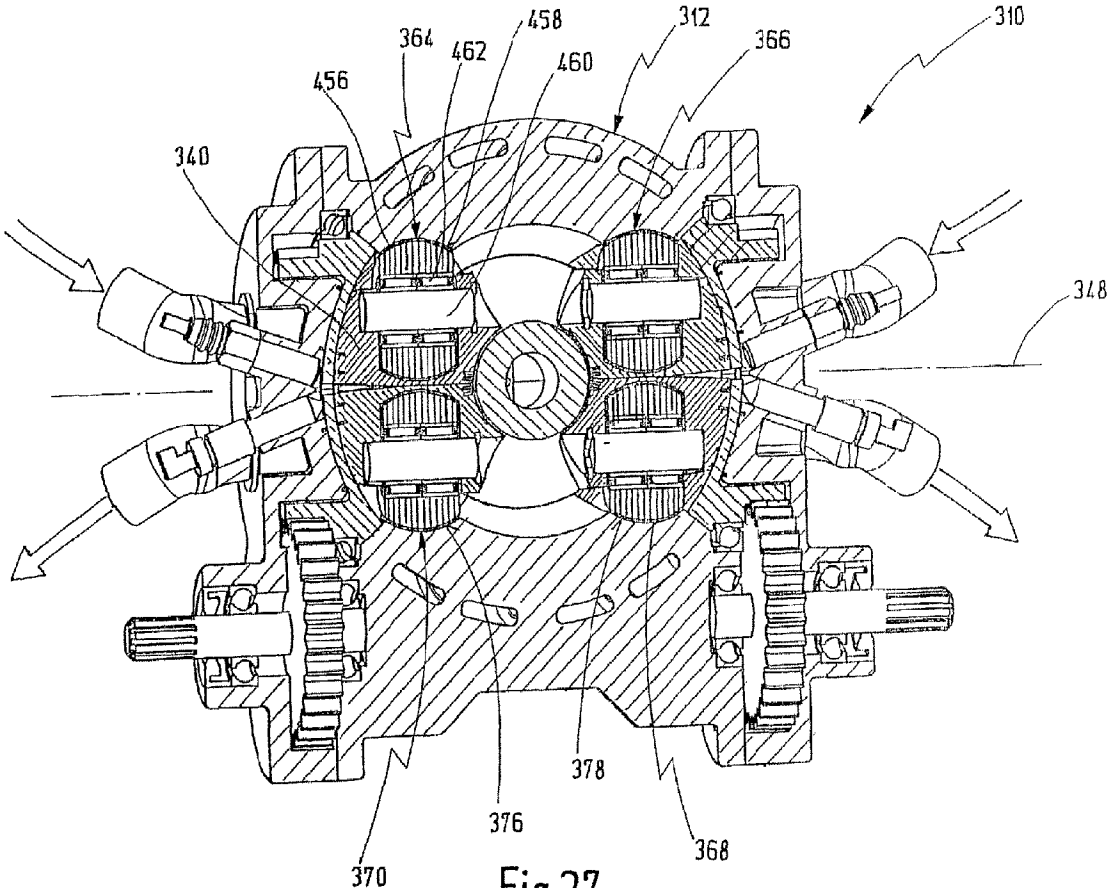
Figure 28:
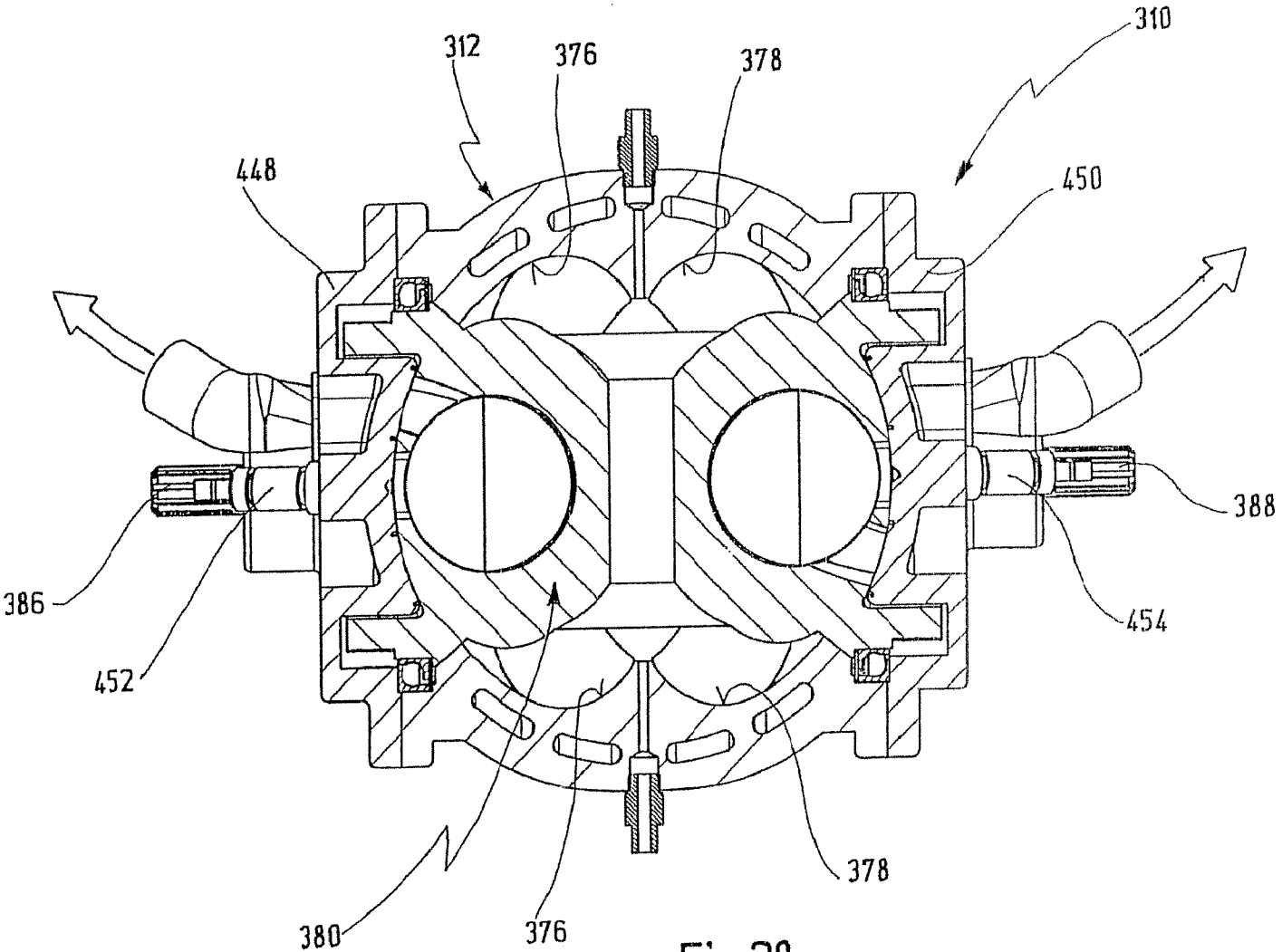

FIGS. 15*a*) to *d*) show various perspective views and sections of a piston of the oscillating piston machine including its running member in stand-alone form;

FIG. 16 shows a longitudinal section through an oscillating piston machine in accordance with a further exemplary embodiment;

FIG. 17 shows a longitudinal section through the oscillating piston machine from FIG. 16 in section along a plane which is rotated through 90° with respect to the sectional plane in FIG. 16;

FIG. 18 is a perspective overall view of an oscillating piston machine according to a further exemplary embodiment;

FIG. 19 shows a longitudinal section through the oscillating piston machine in FIG. 18 along a plane parallel to the rotational axis and perpendicular to the oscillation axis;

FIG. 20 shows a perspective illustration of half of the oscillating piston machine in FIG. 18;

FIG. 21 is a perspective illustration of the arrangement of the piston cage and pistons of the oscillating piston machine in FIG. 18 in stand-alone form and in perspective;

FIG. 22 is a diagram which illustrates the individual working strokes of the oscillating piston machine in FIG. 18;

FIG. 23 is a perspective overall view of an oscillating piston machine according to a further exemplary embodiment;

FIG. 24 shows a section through the oscillating piston machine in FIG. 23 along the line XXIV-XXIV in FIG. 23;

FIG. 25 shows a longitudinal section through the oscillating piston machine in FIG. 23, with the sectional plane in FIG. 25 running perpendicular to the sectional plane in FIG. 24;

FIG. 26 is a sectional illustration, comparable to FIG. 25, of the housing according to an exemplary embodiment which is modified compared to FIG. 25;

FIG. 27 is an illustration, corresponding to FIG. 26, of the oscillating piston machine according to FIG. 26, with the piston cage with the pistons which are accommodated therein being additionally illustrated in longitudinal section in FIG. 27; and FIG. 28 is an illustration which is similar to FIG. 24 but in which the piston cage is illustrated in longitudinal section and in a rotational position offset by 90° in relation to FIG. 24.

Figure 11:
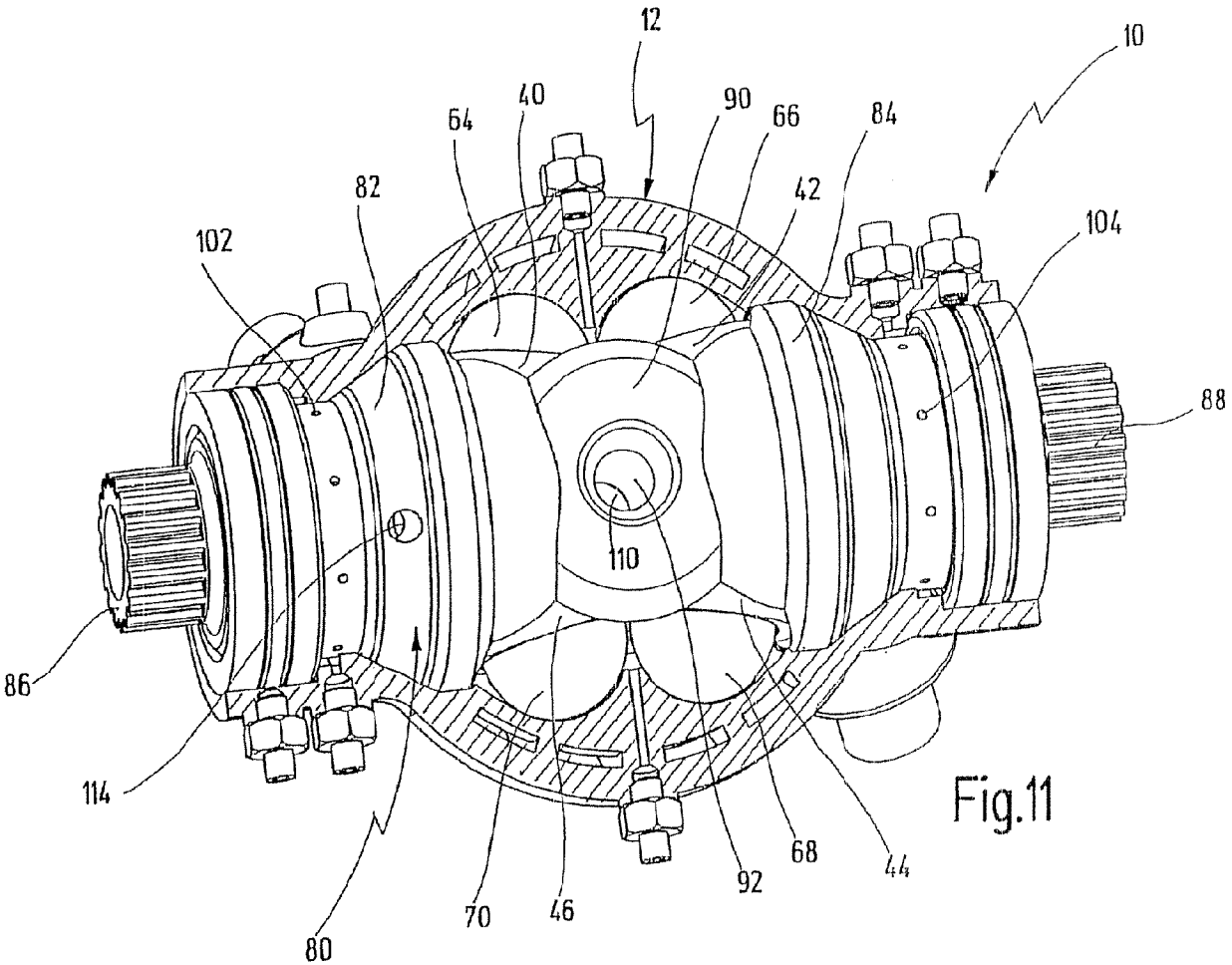
FIG. 11 shows a longitudinal section through the oscillating piston machine similar to that shown in FIG. 3 or 4, but without the piston cage and the pistons being illustrated in section.
Figure 12:
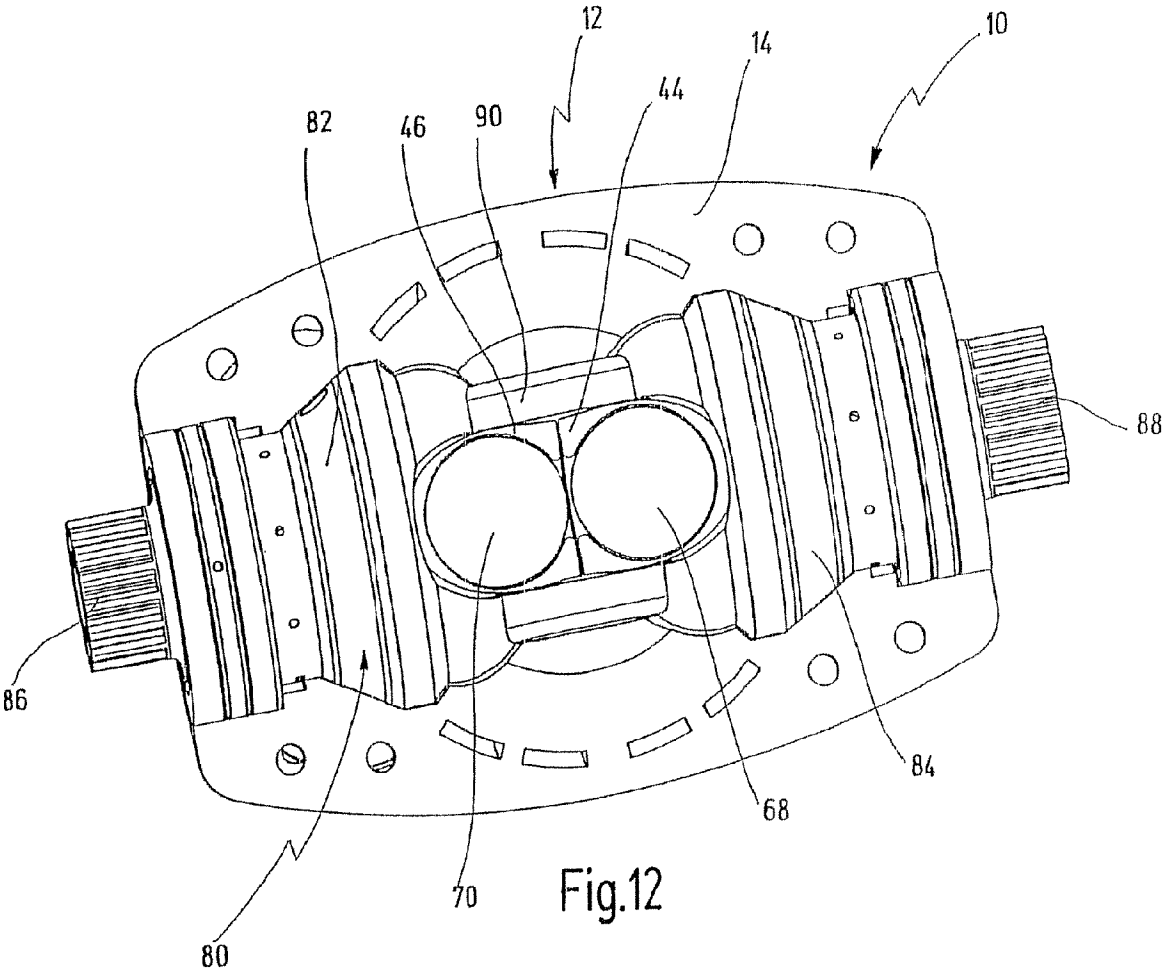
FIG. 12 shows a view of the oscillating piston machine with one half of the housing removed.
Figure 13:
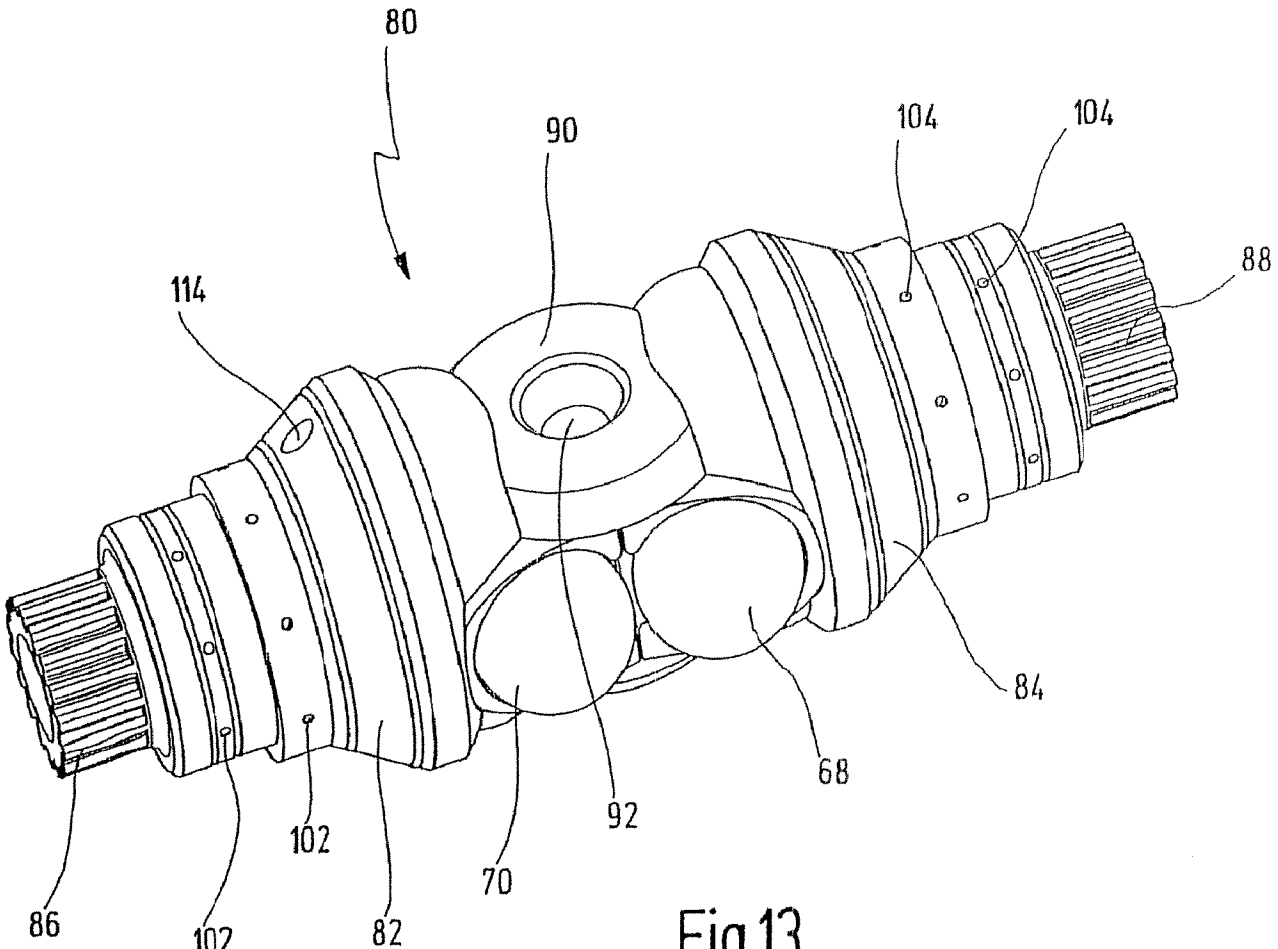
FIG. 13 shows a perspective illustration of the arrangement of piston cage and pistons alone, in perspective.
Figure 14:
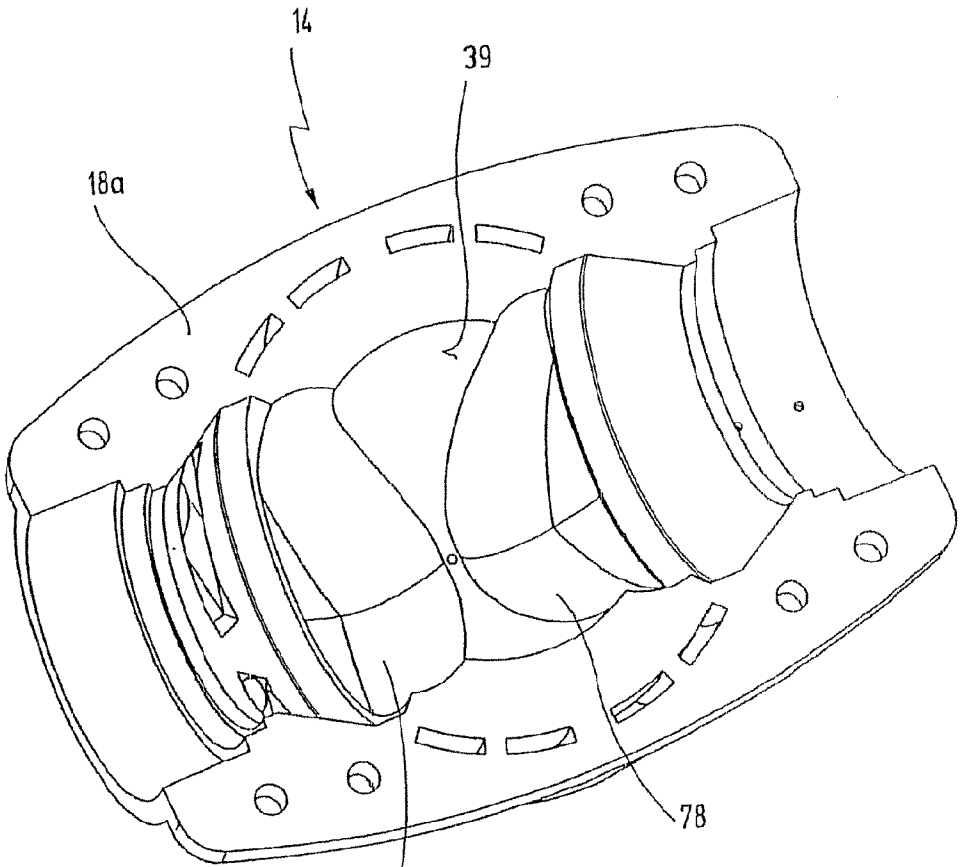
FIG. 14 shows a perspective view of an inner side of a housing half of the oscillating piston machine alone.
Figure 15:
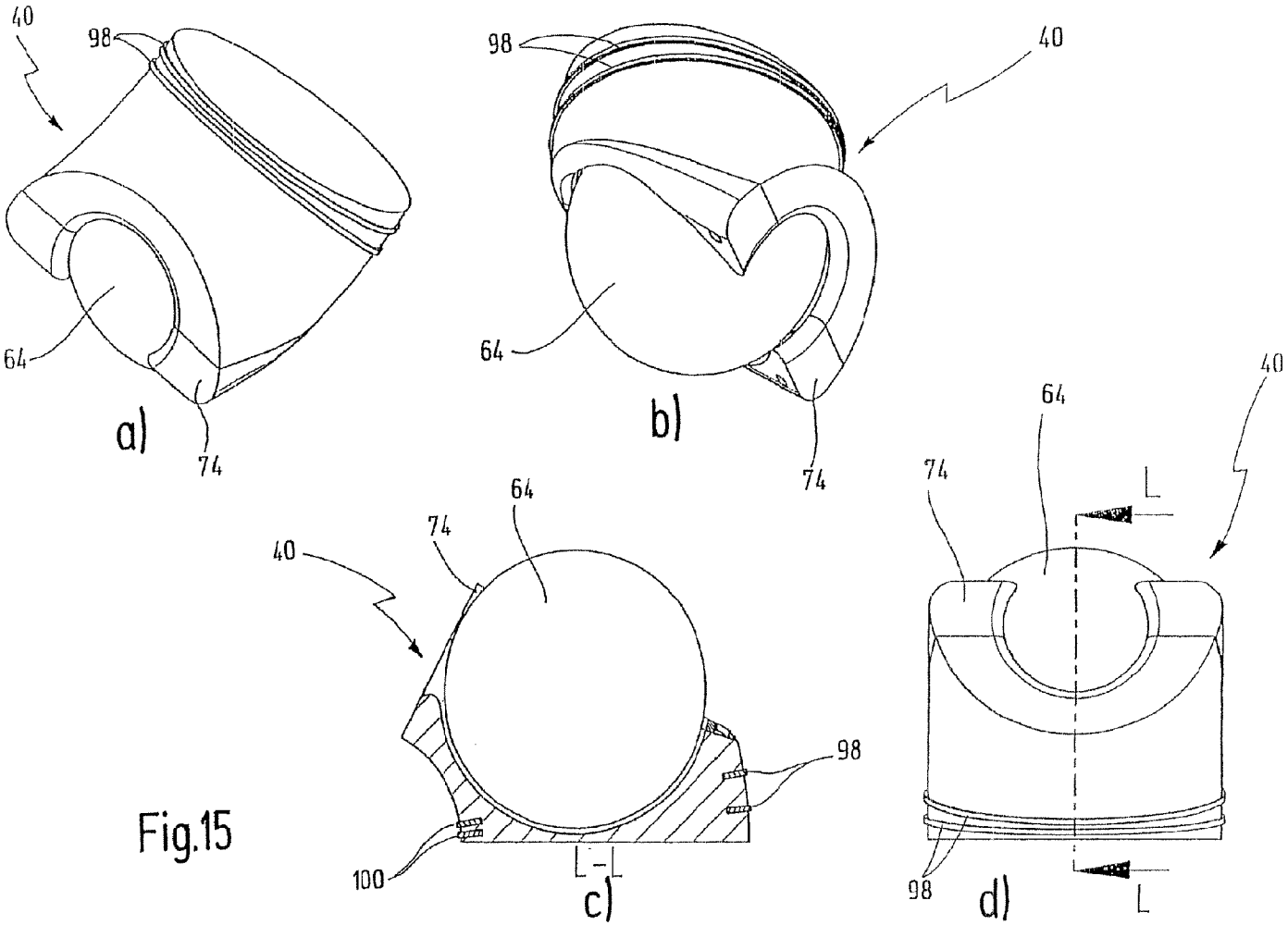

FIGS. 1 to 10 and FIGS. 11 and 12 show various illustrations of an oscillating piston machine provided with the general reference numeral 10. Further details of the oscillating piston machine 10 are illustrated in FIGS. 13 to 15.

In the present exemplary embodiment, the oscillating piston machine 10 is designed as an internal combustion engine.

The oscillating piston machine 10 has a housing 12 which is assembled from two housing halves 14 and 16. The housing halves 14 and 16 each have a flange 18*a* and 18*b*, by means of which the housing halves 14 and 16 are releasably connected to one another.

Figure 2:
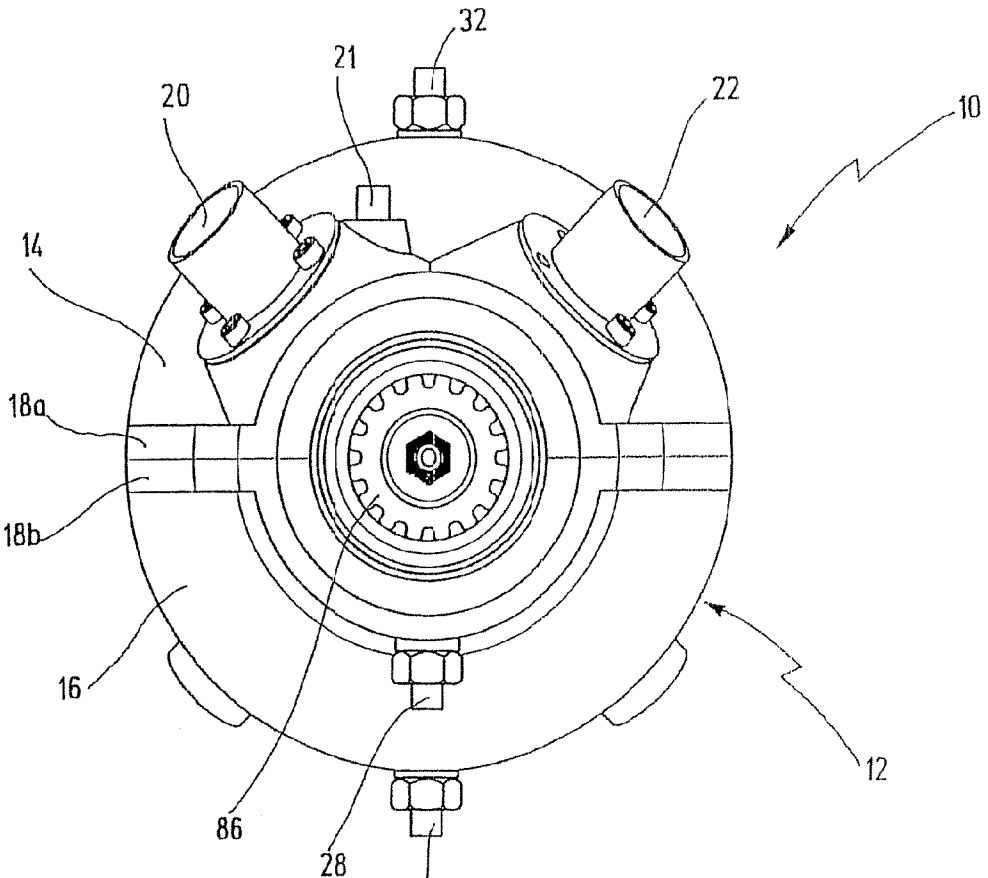
FIG. 2 shows a view of the oscillating piston machine from FIG. 1 in the direction of arrows II in FIG. 1.

Inlet connection pieces 20 and 24 for fresh air/fuel, which are arranged diametrically opposite with respect to the centre of the housing and the openings of which pass through the housing (cf. FIG. 9), are arranged at the housing 12. Outlet connection pieces 22 and 26 are likewise provided. The inlet connection pieces 20 and 24 are used to supply fresh air or combustion air, while the outlet connection pieces 22 and 26 are used to discharge burnt fuel-air mix. The inlet connection pieces 20 and 24 are each assigned a connection for a fuel injection nozzle, as illustrated by a connection 25 for the inlet connection piece 24 (cf. also FIG. 9). FIG. 2 illustrates a corresponding connection 21 for the inlet connection piece 20.

Furthermore, a plurality of connections 28 to 38 for supplying and discharging and/or circulating a cooling/lubricating medium through the interior of the oscillating piston machine 10 are arranged at the housing.

Figure 3:
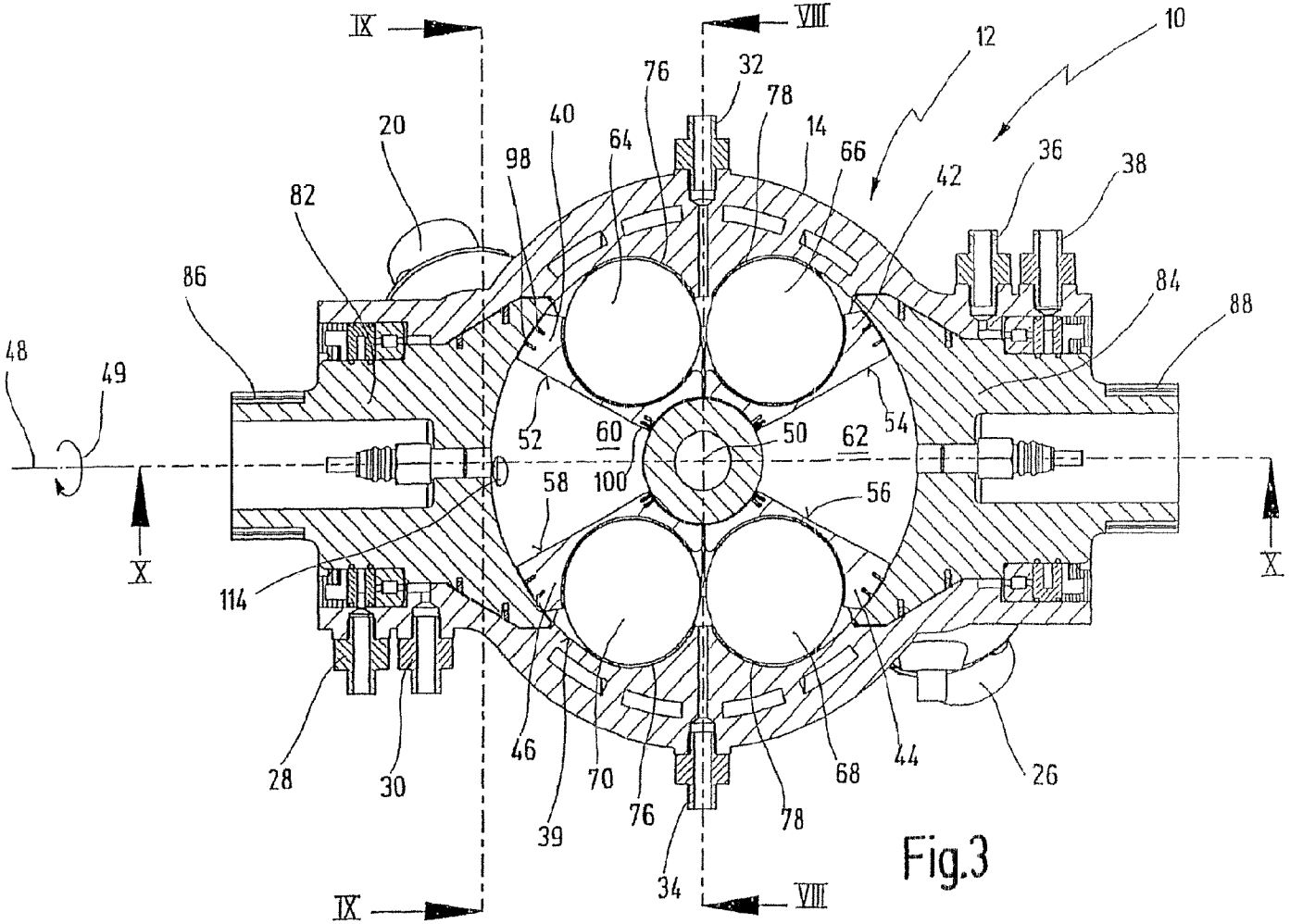
FIG. 3 shows a longitudinal section through the oscillating piston machine on a plane parallel to the rotational axis and perpendicular to the oscillation axis, with the pistons of the oscillating piston machine illustrated in a first operating position.

In the exemplary embodiment of the oscillating piston machine 10, a housing inner wall 39 is substantially spherical in form or is spherical-symmetrical, as can be seen, for example, from FIG. 3.

Four pistons 40 to 46, which in the housing 12 can jointly rotate about a rotational axis 48 as indicated by an arrow 49 (FIG. 3), are arranged in the interior of the housing 12. During this rotating movement, the pistons 40 to 46 execute an oscillating movement, which is superimposed on the rotating movement, about an oscillation axis 50, which is common to all four pistons 40 to 46, between two limit positions, one limit position being illustrated in FIG. 3 (referred to as the BDC position), and the other limit position being illustrated in FIG. 6 (referred to as the TDC position).

Both the rotational axis 48 and the oscillation axis 50, which are to be understood as geometric axes, pass through the centre of the spherical housing 12. Furthermore, the oscillation axis 50 is always perpendicular to the rotational axis 48, but rotates around the latter in accordance with the rotating movement of the pistons 40 to 46 likewise about the rotational axis 48.

Of the pistons 40 to 46, in each case two pistons are positioned diametrically opposite one another with respect to the oscillation axis 50, specifically in every oscillation position of the pistons 40 to 46, and specifically pistons 40 and 44, on the one hand, and pistons 42 and 46, on the other hand, are arranged diametrically opposite one another. However, the pistons 40 to 46 are mounted individually in the housing 12, i.e. are not rigidly connected to one another in pairs.

Each of the pistons 40 to 46 has an end face, i.e. the piston 40 has an end face 52, the piston 42 has an end face 54, the piston 44 has an end face 56 and the piston 46 has an end face 58.

End faces which respectively face one another, i.e. in the present case the end faces 54 and 56 of the pistons 42 and 44 and the end faces 52 and 58 of the pistons 40 and 46, in each case bound a working chamber 60 and 62 serving as combustion chambers. The rotational axis 48 passes through both working chambers 60, 62, preferably centrally in each position of the pistons.

Since respectively adjacent ones of the pistons 40 to 46 execute oscillating movements in opposite directions to one another as they rotate about the rotational axis 48, the working chambers 60 and 62 always increase and decrease in size in the same direction as one another.

Figure 5:
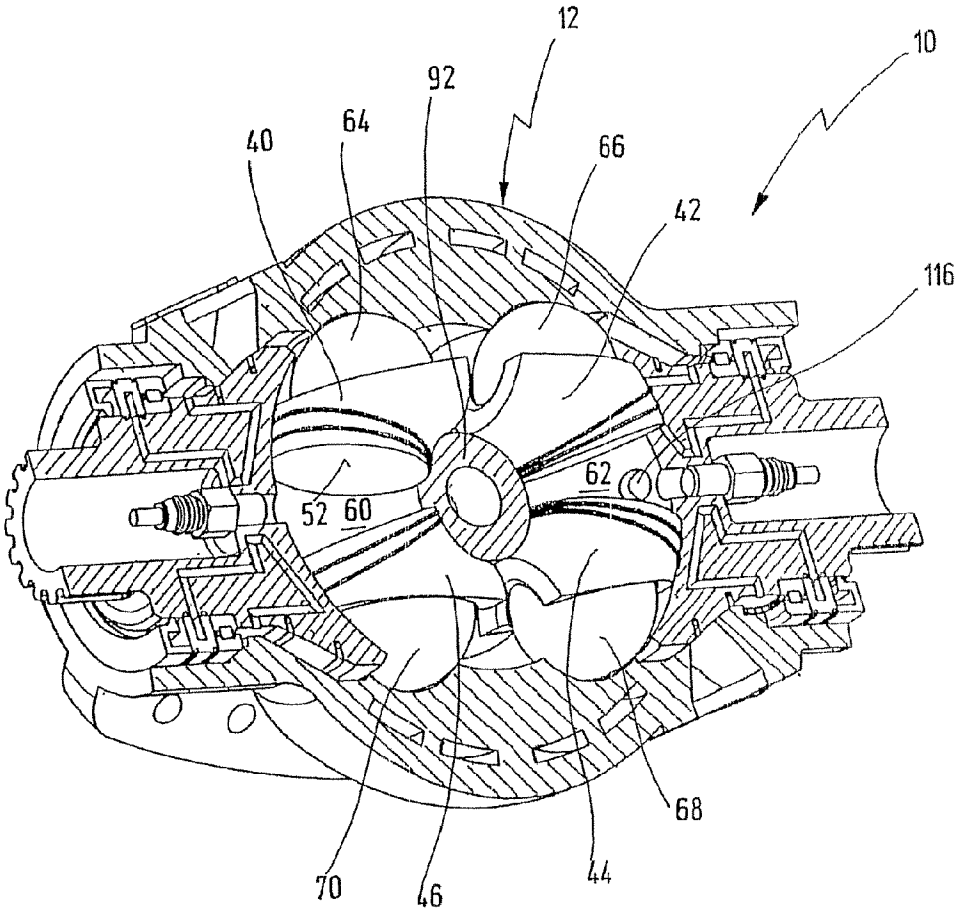
FIG. 5 shows an illustration of the oscillating piston machine comparable to that shown in FIG. 4, with the pistons illustrated in a second operating position.
Figure 6:
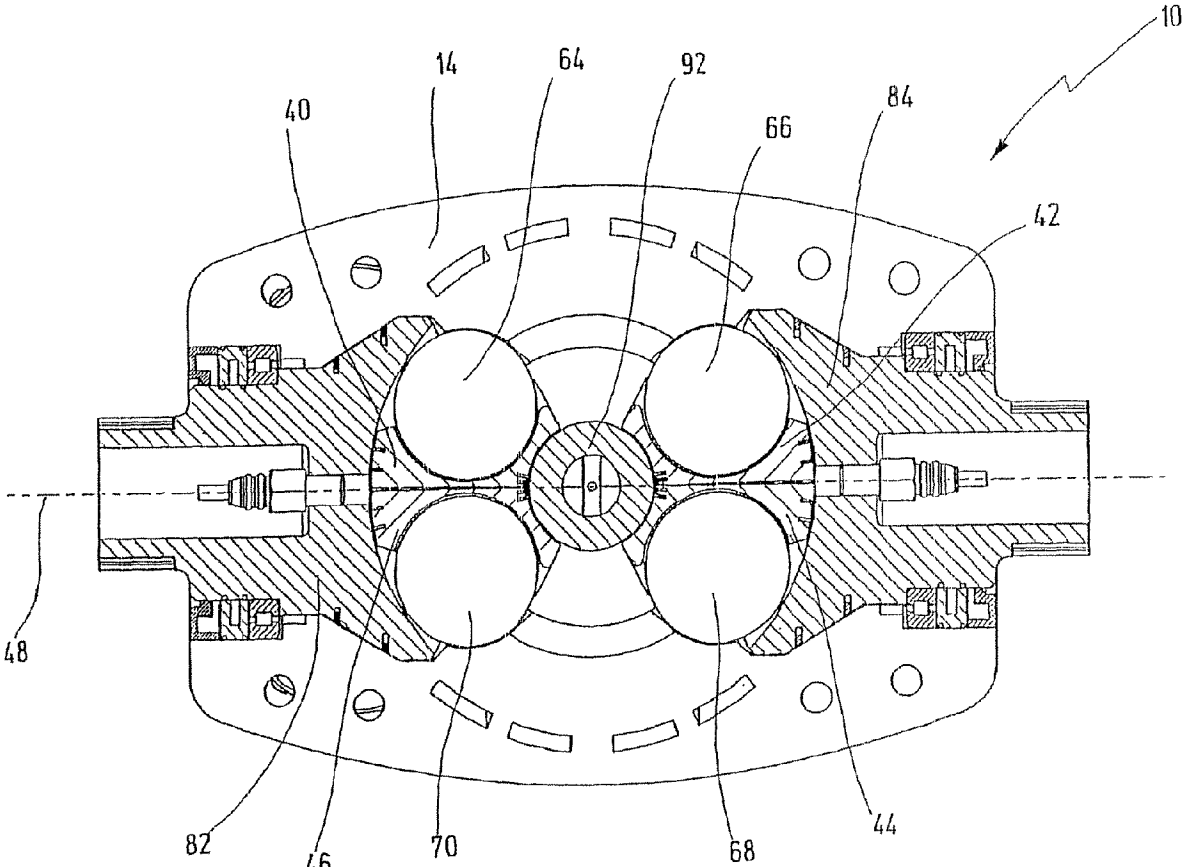
FIG. 6 shows a longitudinal section through the oscillating piston machine from FIGS. 1 to 5, with the pistons illustrated in a third operating position.

By way of example, starting from the state in which the working chambers 60 and 62 have their maximum volume, as shown in FIG. 3, the pistons 40 and 46 oscillate towards one another (FIG. 5), as do the pistons 42 and 44. In the process, the volumes of the working chambers 60 and 62 are reduced until the limit position illustrated in FIG. 6 is reached, in which the working chambers 60 and 62 adopt their minimum volume.

It will be understood that the pistons 40 and 46, as they oscillate about the oscillation axis 50, always remain to the left-hand side of line VIII-VIII in FIG. 3, and pistons 42 and 44 always remain to the right-hand side of the said line.

To derive the oscillating movements of the pistons 40 to 46 about the oscillation axis 50 from the rotating movement of the pistons 40 to 46 about the rotational axis 48, each piston 40 to 46 has a running member 64 (piston 40), 66 (piston 42), 68 (piston 44) and 70 (piston 46). The running members 64 to 70 are balls which are in each case mounted in a ball socket 72, as illustrated for piston 40 in FIG. 15, with the ball socket being arranged on an outer side of the respective piston 40 to 46, facing the housing inner wall 39.

As illustrated in FIG. 3, the balls 64 to 70 may be mounted loosely in the ball sockets 72 and held there by adhesion produced by a lubricating film, in which case the ball sockets 72 do not extend beyond the diameter of the balls 64 to 70, or alternatively the ball sockets may, as illustrated in FIGS. 15*a*) and *b*), hold the balls 64 to 70 in a positively-locking manner and therefore captively by means of an extension 74 extending beyond the diameter of the balls.

In all cases, the balls 64 to 70 can rotate freely in the ball sockets 72 in all directions about their respective centres.

The running members or balls 64 to 70 are assigned two control cams in which the balls 64 to 70 run. More accurately, the balls 64 and 70 of the pistons 40 and 46 are assigned a first control cam 76, which is designed as a groove with a pitch-circle-shaped cross section in the housing inner wall 39. A corresponding control cam 78 is assigned to the running members or balls 66 and 68 of the pistons 42 and 44.

The balls 64 and 70 therefore run in the same control cam 76, and the balls 66 and 68 run in the same control cam 78. The balls 64 and 70, on the one hand, and the balls 66 and 68, on the other hand, are in each case offset by 180° from one another with respect to the rotational axis 48.

The control cams 76 and 78 are arranged at least approximately at the maximum distance from the rotational axis 48, as can be seen from FIG. 3, i.e. they are located approximately at the level of the oscillation axis 50. Overall, the control cams 76 and 78 run substantially orthogonally to the rotational axis 48.

FIG. 14, which shows the housing half 14 alone, provides a perspective illustration of the control cams 76 and 78 in detail.

The pistons 40 to 46 are mounted in the housing 12, in a piston cage 80 which rotates about the rotational axis 48 together with the pistons 40 to 46 and is described in more detail below together with further details of the pistons 40 to 46. FIGS. 11 to 13 illustrate the piston cage 80 in the form of views which are not taken in section.

In the exemplary embodiment shown and preferably, the piston cage 80 is a single-piece component, although a multi-piece design is also conceivable instead of a single-piece design.

The piston cage 80 extends along the rotational axis 48 over the entire length of the housing 12, with shaft extensions 86 and 88 of the piston cage 80 projecting out of the housing.

The piston cage 80 in each case has a main bearing section 82 and 84 which adjoins the shaft extensions 86 and 88 and via which the piston cage 80 is mounted in the housing 12 such that it can rotate about the rotational axis 48. The bearing sections 82 and 84 are connected in the centre of the housing by way of a centre section 90, which has a pin-like section 92 which extends along the oscillation axis 50 and on which the pistons 40 to 46 are mounted with respect to the centre of the housing or the oscillation axis 50.

Figure 10:
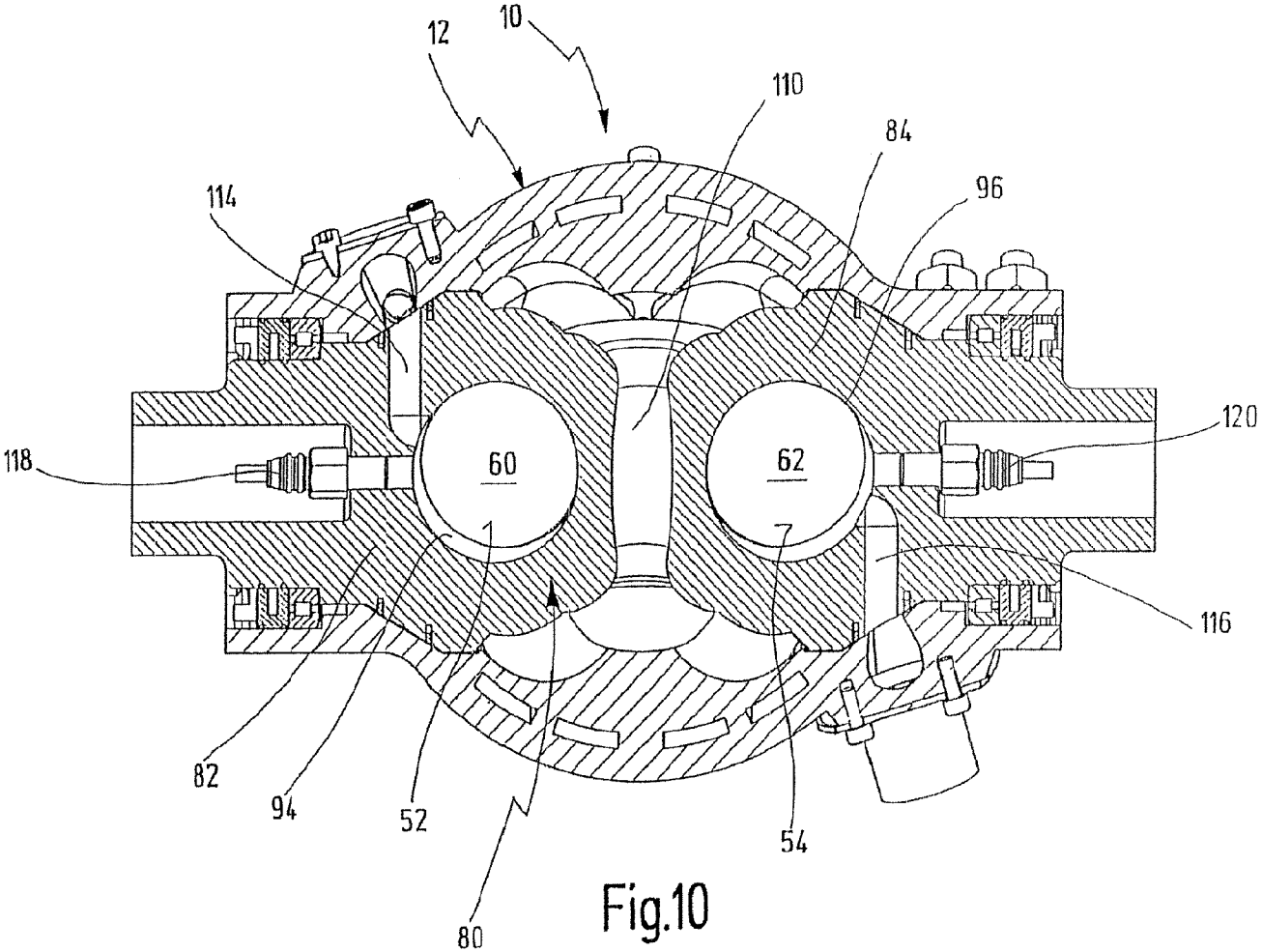
FIG. 10 shows a longitudinal section on line X-X from FIG. 3 through the oscillating piston machine as shown in FIGS. 1 to 9.

In accordance with FIG. 10, the piston cage 80 has two bores 94 and 96, in which the pistons 40 to 46 are slideably mounted. More accurately, the pistons 40 and 46 are mounted slideably in bore 94, and the pistons 42 and 44 are mounted slideably in bore 96. The bores 94 and 96 are circular in form, and accordingly the end faces 52 to 58 of the pistons 40 to 46 are likewise of circular design. The pistons 40 to 46 are mounted in the bores 94 and 96 by means of piston rings for sealing the working chambers 60 and 62, as illustrated by seals 98 (outside) and 100 (inside) for piston 40 in FIG. 3. In accordance with FIG. 3, pistons 42 to 46 have corresponding seals on their radially outer side and their radially inner side.

The bores 94 and 96, together with the end faces 52 to 58, bound the working chambers 60 and 62.

In the bores 94 and 96 in the piston cage 80, the pistons 40 to 46 are connected in a rotationally fixed fashion to the piston cage 80, so that the pistons 40 to 46, together with the piston cage 80, rotate about the rotational axis 48, while the pistons 40 to 46 can move slideably within the bores 94 and 96, in accordance with their oscillating movements about the oscillation axis 50, in order to carry out the individual working strokes of intake, compression, expansion and exhaust.

The pistons 40 to 46 are designed substantially in the form of arcs, as illustrated in FIG. 15, and the working chambers 60 and 62 are also approximately in the form of a curved or arcuate cylinder, with the curvature being concentric with respect to the oscillation axis 50.

The arrangement made up of piston cage 80, pistons 40 to 46 as well as the running members 64 to 70 forms the "inner motor" of the oscillating piston machine 10, i.e. this arrangement comprises all the moving parts of the oscillating piston machine 10.

Figure 4:
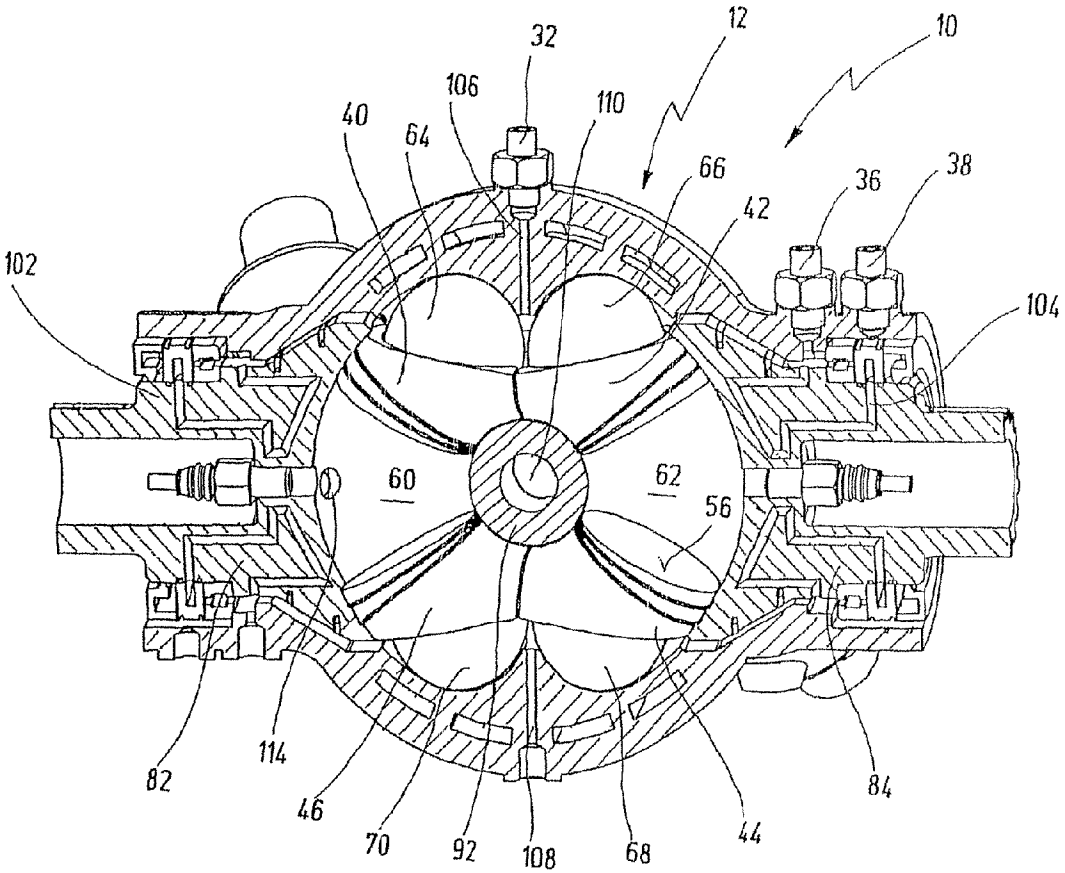
FIG. 4 illustrates the oscillating piston machine in the same operating position of the pistons as in FIG. 3, in the form of a slightly perspective view, without the pistons being shown in section.
Figure 9:
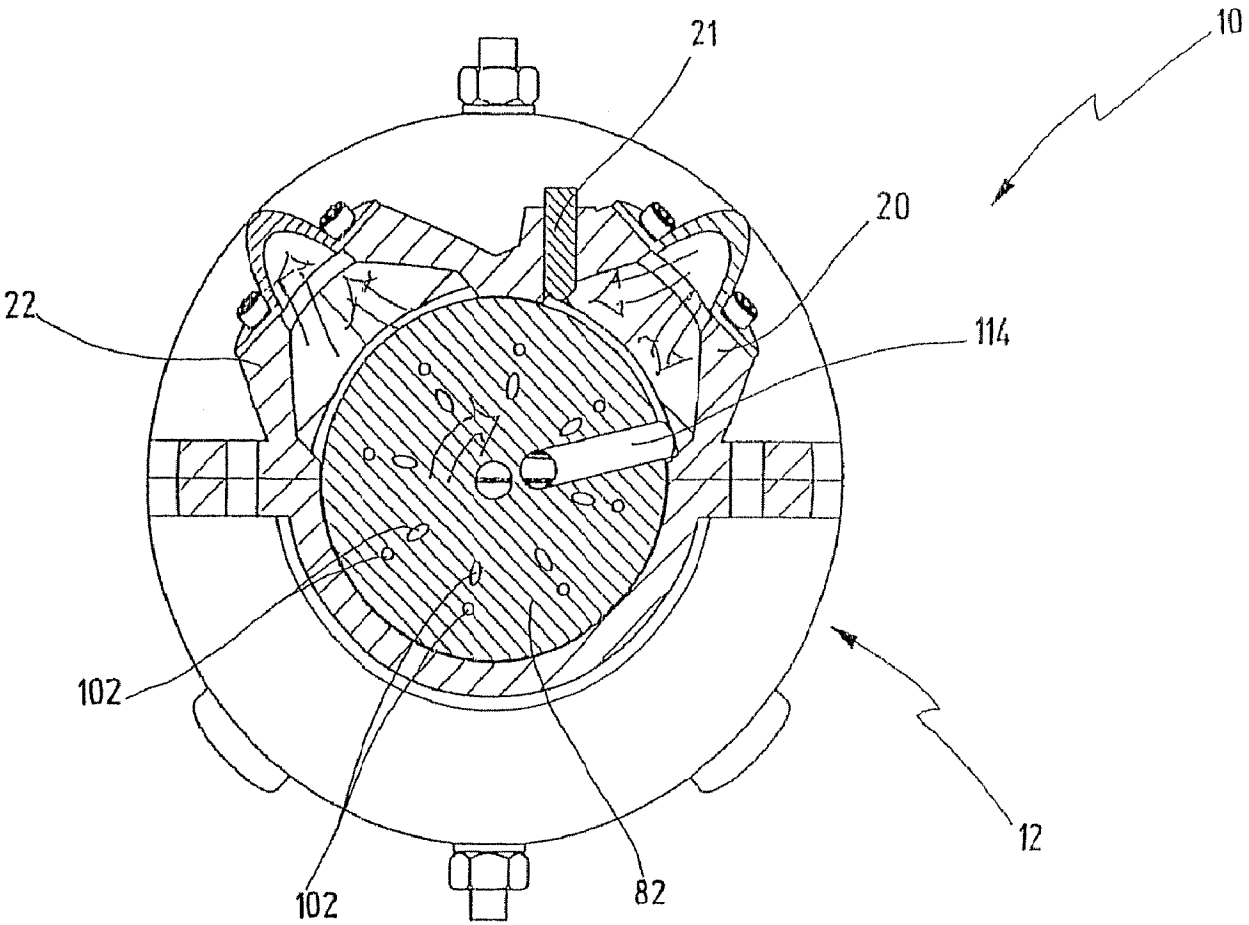
FIG. 9 shows a section through the oscillating piston machine on line IX-IX from FIG. 3.

As illustrated by way of example in FIGS. 4 and 9, a plurality of ducts 102 and 104 are present in the bearing sections 82 and 84, respectively, of the piston cage 80, which ducts extend circumferentially and through the interior of the bearing sections 82 and 84 of the piston cage 80 and are in communication with the connections 28, 30 and 36, 38 which have already been mentioned above, so that a cooling/lubricating medium for cooling and lubricating the piston cage 80 can be passed through the ducts 102, 104. The ducts 102 and 104 serve primarily to cool the inner motor in the vicinity of the working chambers 60, 62.

In accordance with FIG. 4, cooling/lubricating medium ducts 106 and 108 are likewise formed in the housing 12, with a bore 110, which likewise serves as a cooling/lubricating medium duct, passing through the centre section 90 of the piston cage 80 in the direction of the oscillation axis 50. When the piston cage 80 rotates about the rotational axis 48, the cooling/lubricating medium which is present in the bore 110 is thrown towards the housing inner wall 39 as a result of centrifugal forces. In this way, the pistons 40 to 46 and the running members 64 to 70 in the centre of the inner motor are cooled and/or lubricated. At the running members 64 to 70, the lubricating film which forms also serves to hold the running members 64 to 70 in the ball sockets 72 of the pistons 40 to 46 through adhesion, unless, as illustrated in FIG. 15, this is achieved by a positively locking action.

The bore 110 widens out in the shape of a trumpet at both its ends, in order to improve the distribution of the cooling/lubricating medium in the centre of the housing 12 still further.

In accordance with FIGS. 9 and 10, two further bores or ducts 114 and 116 are also provided in the piston cage 80; these bores or ducts on one side open out in the bores 94 and 96, respectively, and on the other side open out towards the housing inner wall 39, specifically at the level of the inlet or outlet connection pieces 20 and 22 or 24 and 26, respectively. The ducts 114 and 116 are used to admit a fuel-air mix to the working chambers 60, 62 through the inlet connection pieces 20 and 24, respectively, in one rotational position of the piston cage 80 about the rotational axis 48, and to discharge burnt fuel-air mix through the outlet connection pieces 22 and 26 in a different rotational position. In the other rotational positions, the piston cage 80 closes off these connection pieces. The piston cage 80 therefore simultaneously performs the function of a valve for opening and closing the connection pieces 20 to 26.

As can also be seen from FIG. 10, a spark plug 118 and 120 for each working chamber 60 and 62 is provided in the piston cage 80, these spark plugs being arranged on the rotational axis 48 and rotating about the latter together with the piston cage 80. Electrical supply conductors (not shown) are correspondingly connected to the spark plugs 118 and 120 via slip rings, for example. If the oscillating piston machine 10 is used as a diesel engine, the plugs 118 and 120 are correspondingly glow plugs.

The arrangement of the connection pieces 20 and 22 offset through 180° about the rotational axis 48 with respect to the connection pieces 24 and 26 serves to ensure that an expansion operation always takes place in at least one of the working chambers 60 and 62 as the pistons 40 to 46 rotate through 360° about the rotational axis 48. Therefore, precisely when an expansion stroke is taking place in the working chamber 60, an exhaust stroke for discharging burnt fuel-air mix is taking place in the working chamber 62, and vice versa.

The way in which the oscillating piston machine 10 functions is described below.

Starting from the operating position of the pistons 40 to 46 shown in FIGS. 3 and 4, the pistons 40 to 46 in that position are in what is known as their BDC (bottom dead centre) position. After rotation through 45° about the rotational axis 48, the pistons 40 and 46 or 42 and 44 have moved halfway towards one another, as illustrated in FIG. 5. The volume of the working chambers 60 and 62 has there been reduced by approximately half. The oscillating movement of the pistons 40 to 46 was in this case imparted by the running members 64 to 70 being guided in the control cams 76 and 78.

Figure 7:
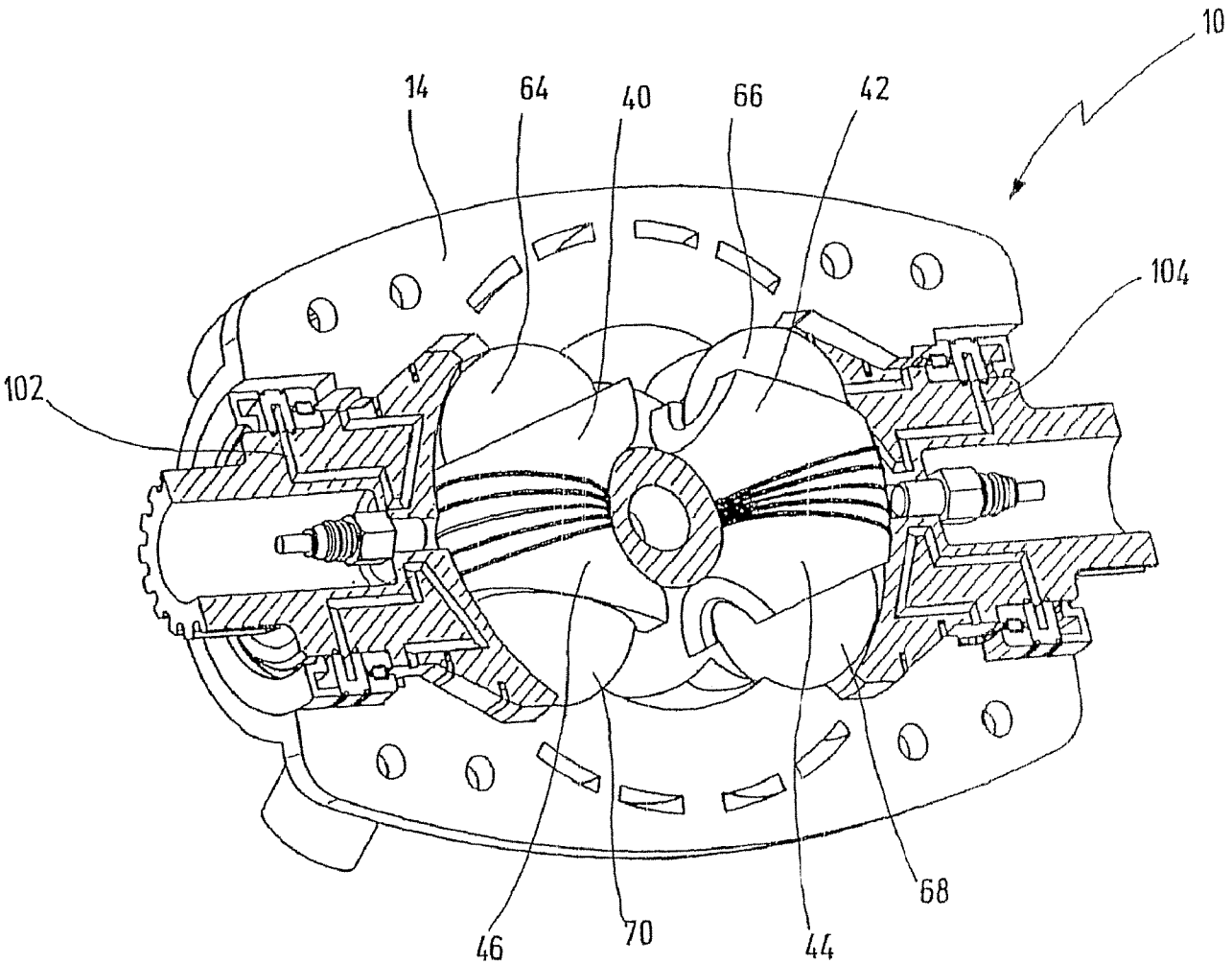
FIG. 7 illustrates the oscillating piston machine with the pistons in the same operating position as in FIG. 6, in the form of a slightly perspective view without the pistons being illustrated in section.
Figure 8:
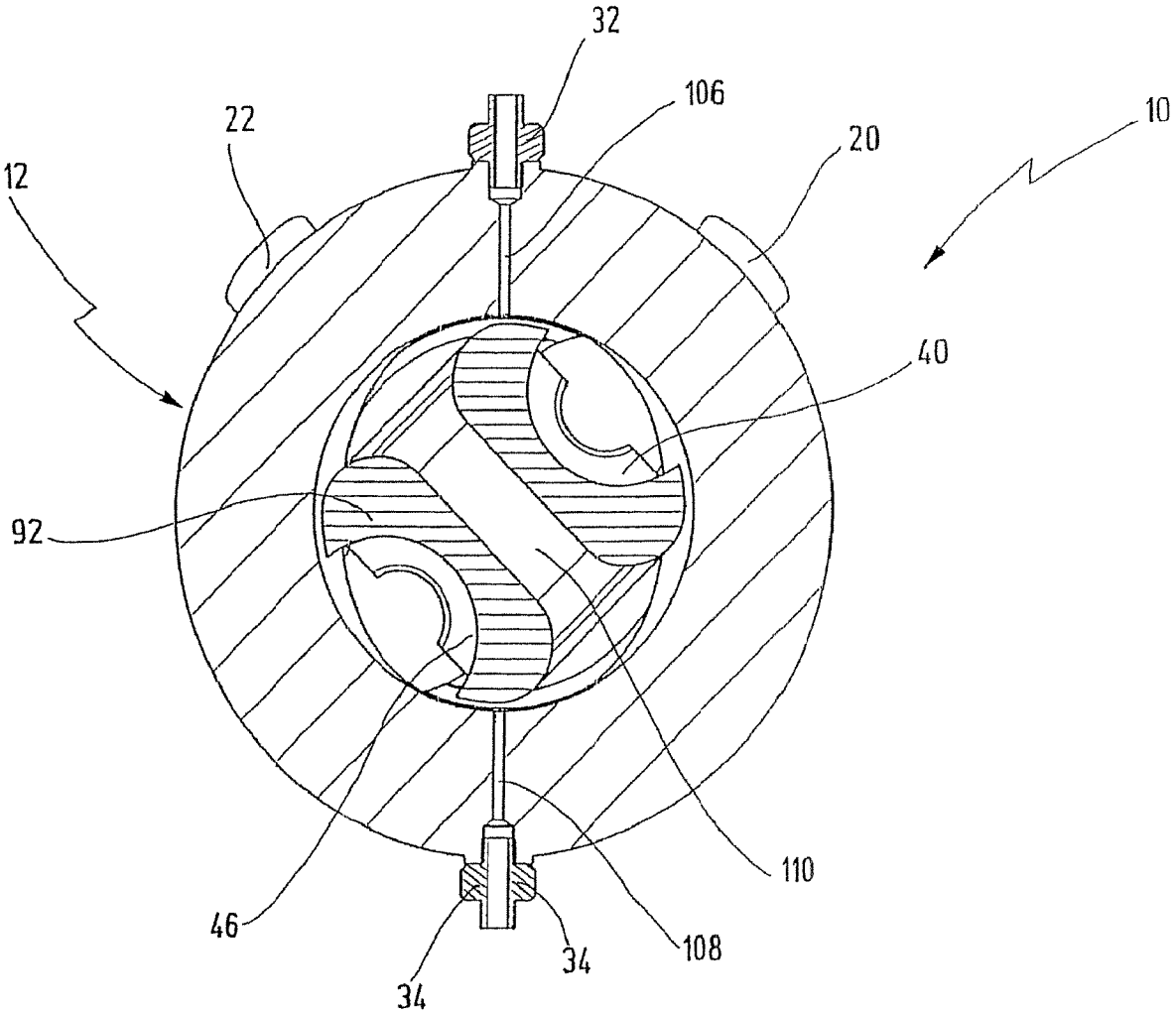
FIG. 8 shows a section through the oscillating piston machine on line VIII-VIII from FIG. 3.

After further rotation through 45° about the rotational axis 48, the pistons 40 to 46 then adopt the TDC (top dead centre) position illustrated in FIGS. 6 and 7, in which the volumes of the working chambers 60 and 62 are at a minimum. After further rotation through 45° about the rotational axis 48, progressing in the same direction, the pistons 40 to 46 then return to the position shown in FIG. 5, and after further rotation through 45° they once again adopt the position shown in FIG. 3. The working chambers 60 and 62 are once again at a maximum after rotation through 180° about the rotational axis 48.

Therefore, after a full rotation through 360°, the four strokes of intake, compression, expansion and exhaust have taken place once in each of the working chambers 60 and 62.

Figure 10A:
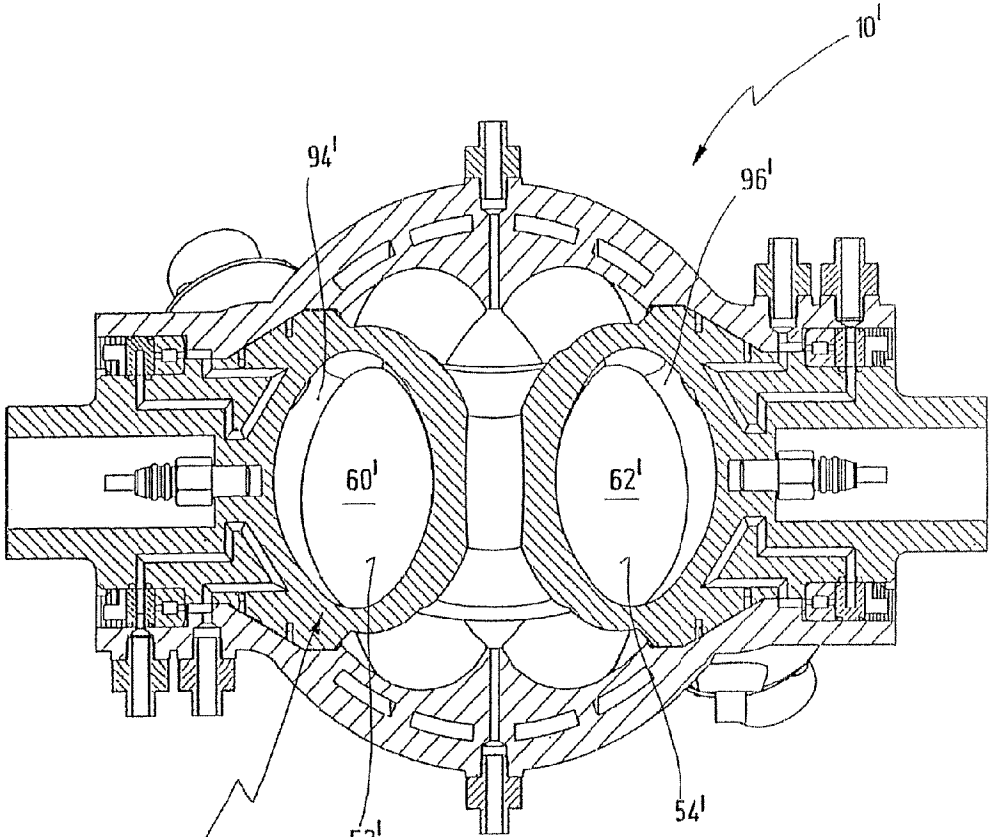
FIG. 10A shows an illustration comparable to FIG. 10 of a modified exemplary embodiment of the oscillating piston machine.

FIG. 10A illustrates a slightly modified configuration of an oscillating piston machine 10', which differs from the oscillating piston machine 10 only by virtue of the fact that the bores 94' and 96' in the piston cage 80', and accordingly the end faces 52' and 54' (and the same is also true of the end faces 56' and 58', which are not illustrated) are not circular, but rather, as illustrated by way of example in FIG. 10A, are oval or elliptical in form. This allows the size of the working chambers 60' and 62' to be increased compared to the circular configuration.

FIGS. 16 and 17 illustrate yet another exemplary embodiment of an oscillating piston machine 10", which differs from the oscillating piston machine 10 or oscillating piston machine 10' as follows.

Whereas the housing 12 of the oscillating piston machine 10 and of the oscillating piston machine 10' is spherical-symmetrical, the housing 12" of the oscillating piston machine 10" is of oblong design. More specifically, the housing 12" comprises two hemispheres 13" and 15", between which there is inserted an elongate section 17" extending in the direction of the rotational axis 48". This makes the housing 12" longer in the direction of the rotational axis 48" compared to the design of the housing 12, which allows the following measures.

A hollow pin 122, which has an opening 124 in its wall, is arranged on the inner side of the centre section 90" of the piston cage 80", which in accordance with FIG. 17 is likewise designed to be oblong in cross section. The centre section 90" has two openings 126 and 128 on the rotational axis 48", with which the opening 124 in the hollow pin 122 is in communication depending on its rotational position, although the opening 124 can in each case only be in communication with one of the openings 126 and 128 at a time. The hollow pin 122 is mounted in the centre section 90" such that it can rotate about the oscillation axis 50". The rotational movement of the hollow pin 122 about the oscillation axis 50" is derived from the rotating movement of the piston cage 80" about the rotational axis 48". For this purpose, at one end the centre section 90" has a transmission mechanism 130, which includes worm toothing 132 fixedly connected to the hollow pin 122. The worm toothing or worm gear 132 meshes with toothing 134 arranged concentrically around the rotational axis 48, so that when the centre section 90" including the hollow pin 122 rotates about the rotational axis 48 the worm toothing 132 and therefore the hollow pin 122 are made to rotate about the oscillation axis 50".

Furthermore, an inlet 136 for fresh air, which can be opened and closed by, for example, a standard valve device 138, is provided in the housing. Fresh air, in particular pre-compressed fresh air, can now be introduced into the interior of the hollow pin 122 through the inlet 136, and then, depending on the rotational position of the hollow pin 122 relative to the openings 126, 128, the fresh air is introduced into the working chambers 60" or 62", specifically in addition to the supply of fuel-air mix through the connection pieces 20" and 24". This makes the oscillating piston machine 10" what is known as a supercharged engine.

The worm toothing 132 and the toothing 134 are accordingly to be designed in such a way that the rotational movement of the hollow pin 122 about the oscillation axis 50" is suitably synchronized with the piston positions of the pistons 40" to 46". This means that the supply of fresh air through the hollow pin 122 into the working chamber 60" or into the working chamber 62" should preferably take place when, or the opening 124 should be in communication with the respective opening 126 and 128 when, the ignition of the fuel-air mix admitted through the inlet connection pieces 20" and 24" is just on the verge of igniting. Rotation of the hollow pin through 360° about the rotational axis 48" should cause it to rotate through 360° about the oscillation axis 50.

Otherwise, the oscillating piston machine 10" corresponds to the configurations of the oscillating piston machine 10 or 10', and consequently in this respect reference can be made to the description given of those oscillating piston machines.

FIGS. 18 to 21 show a further exemplary embodiment of an oscillating piston machine 210 and its details. In FIGS. 18 to 21, parts which are the same as or comparable to the parts of the oscillating piston machine 10, 10' and/or 10" are used with the same reference symbols but increased by 200. For example, the oscillating piston machine 210 therefore has a housing 212. In the text which follows, only aspects of the oscillating piston machine 210 which differ from the previously described exemplary embodiments will be described.

The oscillating piston machine 210 has, in the housing 212, four pistons 240 to 246, with the pistons 240 and 246 being arranged as a first piston pair, and the pistons 242 and 244 being arranged as a second piston pair with respect to the rotational axis 248 in such a way that the oscillating movements of the pistons 240 and 246 occur in a first plane, and the oscillating movements of the pistons 242 and 244 occur in a second plane, with the first and second planes being rotated in relation to one another with respect to the rotational axis 248 by an angle which is unequal to 0°, and by 90° with respect to one another in the present exemplary embodiment.

This means that the oscillation axis of the pistons 240 and 246 runs perpendicular to the oscillation axis of the pistons 242 and 244. In FIG. 19, an oscillation axis 250 of the pistons 242 and 244 is shown which runs perpendicular to the plane of the drawing in FIG. 19, while an oscillation axis 251 of the pistons 240 and 246 runs perpendicular to the oscillation axis 250 and thus in the plane of the drawing in FIG. 19.

The arrangement of the piston pairs 240, 246 and 242, 244 which is offset by 90° with respect to the rotational axis 248 also becomes clear from FIG. 21 in which a piston cage 280 of the oscillating piston machine 210 is illustrated with the pistons 240 to 246 and assigned running members 264, 266, 268, 270 in the form of balls in stand-alone form. The parts of the oscillating piston machine 210 which are illustrated in FIG. 21 together again form the inner motor of the oscillating piston machine 210.

The piston cage 280 correspondingly differs from the piston cage 80 of the oscillating piston machine 10 by virtue of the fact that the bores 294 and 296 which define the working chambers 260 and 262 run orthogonally with respect to one another.

Figure 1:
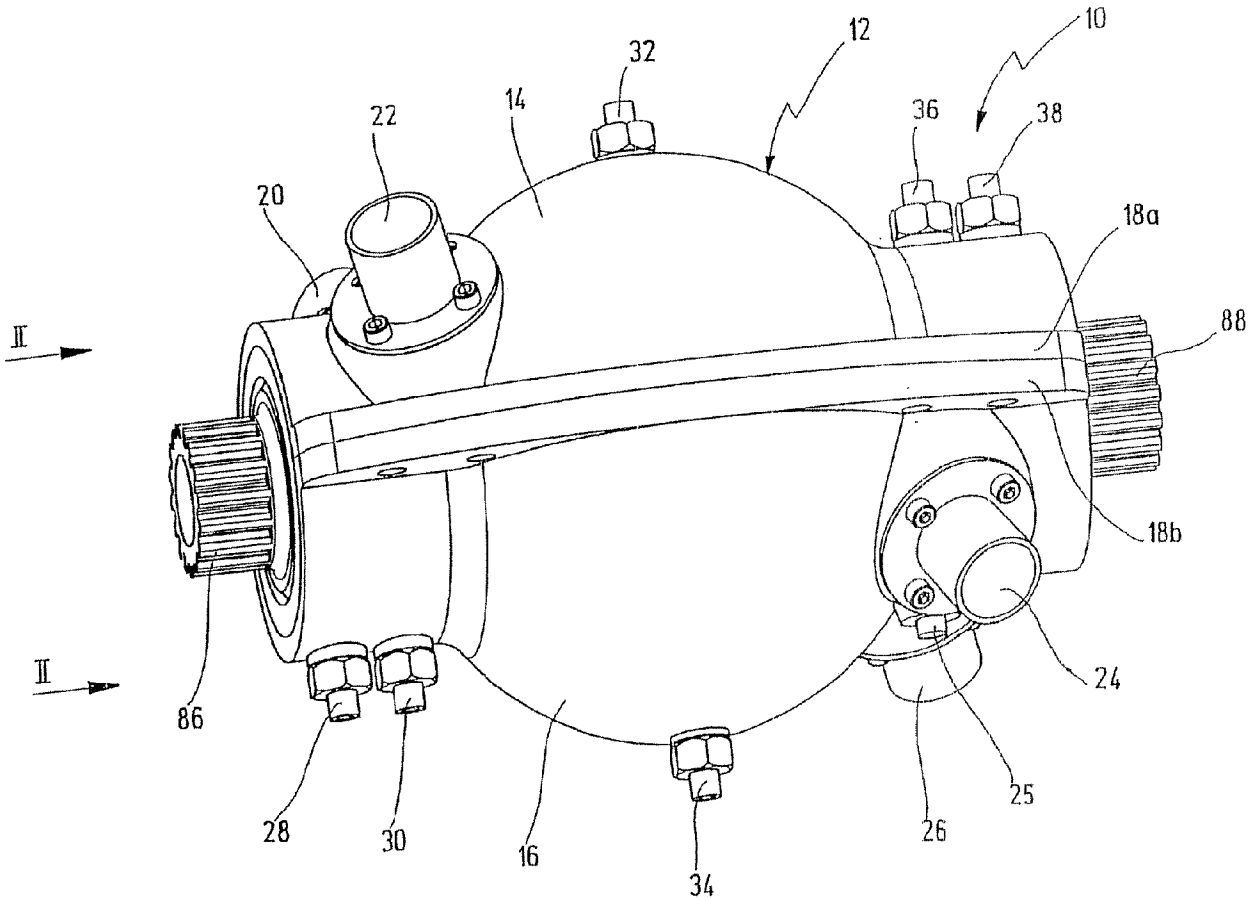
FIG. 1 shows a perspective overall view of an oscillating piston machine according to a first exemplary embodiment.

The maximum opening angle of the respective pairs of pistons 240, 246 and 242, 244, and thus the maximum volume of the working chambers 260, 262, are increased compared to the oscillating piston machine 10 in FIG. 1 by the fact that the working chambers 260 and 262 are arranged orthogonally with respect to one another by virtue of the correspondingly orthogonal arrangement of the pairs of pistons 240, 246 and 242, 244, with respect to one another.

This becomes apparent, for example, from a comparison of FIGS. 19 and 3. FIG. 3 shows the pistons 40 to 46 in, as already described above, their maximum opening angle or their BDC position in which the working chambers 60 and 62 assume their maximum volume.

FIG. 19 correspondingly shows the pistons 240 to 246 in their maximum opening angle with respect to the oscillation axes 250 and 251, i.e. also in their BDC position.

While in the oscillating piston machine 10 all four pistons 40 to 46 can oscillate about the common oscillation axis 50 or, in other words, the oscillating movements of the pistons 40 to 46 run in the same plane and the working chambers 60 and 62 are thus arranged in the same plane, this means that the running members 64 and 66, on the one hand, and 68 and 70, on the other hand, come very close to one another in this arrangement, approximately on the orthogonal to the rotational axis 48, as a result of which the associated control cams 76 and 78 have to be embodied in such a way that in the BDC position the running members 64 and 66, on the one hand, and 68 and 70, on the other hand, do not collide with one another.

Arranging the piston pairs 240, 246, on the one hand, and 242, 244, on the other hand, with a 90° offset according to the oscillating piston machine 210 avoids this problem since the running members 264, 266 and 268, 270 also run offset with respect to one another in their control cams 276 and 278. As a result, the control cams 276, 278 can be constructed so that they come closer to the orthogonal (line A in FIG. 19) or extend beyond it, as a result of which the maximum opening angle of the piston pairs 240, 246 and 242, 244 can be increased compared to the oscillating piston machine 10, by approximately 10° in the exemplary embodiment shown. However, the maximum volume of the working chambers 260, 262 of the oscillating piston machine 210 is thus also increased, as a result of which a still higher compression ratio can be achieved with the oscillating piston machine 210 than with the oscillating piston machine 10.

As in the oscillating piston machine 10, the working chambers 260, 262 of the oscillating piston machine 210 increase and decrease in size in the same direction as one another. For example, if the working chamber 260 expands in the course of a working stroke, the working chamber 262 expands in order to suck in new fresh gas. The two processes thus take place simultaneously but offset by 90° with respect to one another in spatial terms. As a result, the two working chambers 260, 262 always open and close at the same time, which is desirable.

Furthermore, according to FIG. 18, inlet connection pieces 220 and 224 in the oscillating piston machine 210 are not arranged diametrically opposite one another with respect to the rotational axis 248 as in the oscillating piston machine 10 but rather arranged offset with respect to one another by 90°. The same applies to outlet connection pieces 222, of which only the outlet connection piece 222 which is assigned to the working chamber 260 can be seen in FIG. 18.

FIG. 22 is a diagram illustrating the function of the oscillating piston machine 210 in terms of the working strokes of expansion, exhaust, intake and compression in the two working chambers 260 and 262.

The control cams 276 and 278 are illustrated in developed form in the diagrams, this illustration revealing that the two control cams 276 and 278 now run parallel to one another in a serpentine shape, while the control cams 76 and 78 of the oscillating piston machine 10 are formed or arranged mirror-symmetrically with respect to a central plane through the centre point of the housing 12 perpendicular to the rotational axis 48.

FIG. 22 also symbolically illustrates a rectangle for the respective piston pair 240, 246 (working chamber 260) and the associated running members 264, 270 in the form of a part of a circle, with the running members 264, 270 running along the control cam 276. The same is illustrated for the second piston pair 242, 244 and their running members 264, 270 with respect to the control cam 278 and the working chamber 262.

A further exemplary embodiment of an oscillating piston machine 310 is illustrated in FIGS. 23 to 28. Parts of the oscillating piston machine 310 which are comparable with the corresponding parts of the oscillating piston machine 10 or 210 have been provided with the same reference symbols, increased by 300, in FIGS. 23 to 28. Only the differences between the oscillating piston machine 310 and the oscillating piston machine 10 are described below. If some parts of the oscillating piston machine 310 are not described in more detail below, the description of the oscillating piston machine 10 or of the oscillating piston machine 10', 10" and/or 210 applies to these parts.

In the case of the oscillating piston machine 310, the output shaft and/or drive shaft is not arranged concentrically on the rotational axis 348 but rather at a lateral distance from it. The piston cage 380 is provided with a crown gear 440 at the end side and concentrically with respect to the rotational axis 348, said crown gear 440 meshing with a crown gear 442 which is connected in a rotationally fixed fashion to the output shaft and/or drive shaft 387. In addition to the crown gear 440, the piston cage can be provided with a second crown gear 444 on the end side lying opposite the crown gear 440. The drive shaft and/or output shaft 387 is embodied so as to extend uninterruptedly between its shaft extensions 386 and 388 so that a drive connection to the piston cage 380 is necessary only via one of the crown gears 440 or 444, as is illustrated in FIG. 25.

FIG. 26 represents an embodiment which is modified with respect to the latter and in which the drive shaft and/or output shaft is not embodied so as to extend continuously between the shaft extensions 386' and 388' but rather the shaft extensions 386' and 388' are both connected in each case via crown gears 442 and 446 to the crown gears 440 and 444. In contrast to the illustration in FIG. 26, by virtue of this configuration the shaft extensions 386' and 388' can also be configured with an axial offset and/or with different transmission ratios with respect to one another. In this way it is possible to drive, for example, an assembly via one of the shaft extensions 386' or 388', and the other is connected to the drive train of the vehicle.

Since in the case of the oscillating piston machine 310 the drive shaft and/or output shaft 387 does not lie on the rotational axis 348 around which the piston cage 380 and the pistons 340 to 346 which are located therein rotate, the spark plugs 418 and 420 can be mounted on a respective end-side housing lid 448 or 450, that is to say on non-rotating parts, and in particular do not need to rotate along with the piston cage 380. The housing lids 448 and 450 are removable parts of the housing 312.

Likewise, in the oscillating piston machine 310 it is possible, as illustrated, for injection nozzles 452 and 454 to be arranged assigned to the two working chambers 360 and 362 (cf. FIG. 24), on the end-side housing lids 448 and 450.

In this configuration it is also possible to provide inlet connection pieces 490, 492 for air, and outlet connection pieces 494, 496 for burnt mixture on the end sides of the housing lids 448 and 450.

A further difference between the oscillating piston machine 310 and the previously described oscillating piston machines 10, 10', 10" and 210 is the configuration of the running members 364 to 370 which are assigned to the pistons 340 to 346.

The running members 364 to 370 are each embodied as a roller, as described below with respect to the running member 364 in the form of the roller 456. The roller 456 has a running face 458 which is in the form of part of a circle transversely with respect to the circumferential direction of the roller 456. The roller 456 is connected via a shaft 460 to the piston 340, with the roller 456 being rotatable relative to the piston 340 about the shaft 460. The shaft 460 runs parallel to the rotational axis 348. The roller 456 is for this purpose preferably rotatably mounted on the shaft 460 by means of a needle bearing, in particular a precision needle bearing. The roller 456 is additionally connected to the piston 340 in a detachable fashion by means of securing rings which are arranged on the end side of the shaft 460.

As in the previously described oscillating piston machines 10, 10', 10" and 210, each running member 364 to 370 extends in the form of a respective roller 456 in a control cam 376 or 378 which correspondingly partially engage in the running members 364 and 370 and along which they are correspondingly guided.

In contrast to the illustration, the arrangement of the pistons 340 to 346 which is selected can also be that of the pistons 240 to 246 of the oscillating piston machine 210, that is to say in such a way that the oscillating pistons 340 and 346 are arranged opposite the pistons 342 and 344 and offset in relation to one another by 90° with respect to the rotational axis 348. In this case, the control cams 376 and 378 can also be formed, like in the case of the oscillating piston machine 210, with two wave peaks and two wave troughs in order to achieve relatively large oscillating strokes of the pistons 340 to 346, as has already been described with reference to the oscillating piston machine 210.

Furthermore, it is possible, in all the previously described oscillating piston machines, to use the chambers, facing away from the two working chambers, between the pistons as admission pressure spaces, as is described in WO 03/0670233 A1 with respect to the oscillating piston machine according to said document.

The invention claimed is:

1. An oscillating piston machine, comprising:

a housing;

a first and a second piston arranged in said housing, said first piston having a first end face and said second piston having a second end face facing said first end face, a rotational axis fixed with respect to said housing, about which said first piston and said second piston can rotate together in said housing, said pistons, when rotating about said rotational axis, carrying out reciprocating oscillating movements in opposite directions to one another about an oscillation axis which extends perpendicular to said rotational axis, a working chamber bound by said first end face and said second end face, said first piston and said second piston being arranged such that said rotational axis extends through said working chamber;

wherein a third piston and a fourth piston are further arranged in said housing, said third piston and said fourth piston rotating with said first piston and said second piston about said rotational axis, said third piston and said fourth piston defining a second working chamber;

wherein said first piston, said second piston, said third piston and said fourth piston are arranged with respect to said rotational axis in such a way that said oscillating movements of said first and second pistons occur in a first plane, and said oscillating movements of said third and fourth pistons occur in a second plane;

wherein said first and second planes are rotated relative to one another by an angle which is unequal to 0° with respect to said rotational axis.

2. The oscillating piston machine of claim 1, wherein said first end face and said second end face are of circular design.

3. The oscillating piston machine of claim 1, wherein said first piston and said second piston are of an arcuate design.

4. The oscillating piston machine of claim 1, wherein at least one of said first piston and said second piston have at least one running member which, as said at least one of said first piston and said second piston rotates, is guided along a correspondingly designed control cam in order to generate said oscillating movements of said at least one of said first piston and said second piston, wherein said control cam is arranged on said housing at least at a maximum distance from said rotational axis.

5. The oscillating piston machine of claim 4, wherein said at least one running member is a ball which is rotatably mounted in a ball socket on an outer side, facing said housing, of said at least one of said first piston and said second piston, and wherein said control cam is embodied as a groove with a pitch-circle-shaped cross section in said housing, said ball partially engaging into said groove.

6. The oscillating piston machine of claim 1, wherein said first piston and said second piston are mounted in a sliding fashion in a piston cage which is arranged in said housing concentrically with respect to said rotational axis so as to be rotatable about said rotational axis, wherein said piston cage is connected in a rotationally fixed fashion to said first piston and said second piston with respect to a rotating movement about said rotational axis.

7. The oscillating piston machine of claim 6, wherein said piston cage is connected to a drive shaft/output shaft which extends parallel to said rotational axis.

8. The oscillating piston machine of claim 7, wherein said drive shaft/output shaft is arranged concentrically with respect to said rotational axis and is connected in a rotationally fixed fashion to said piston cage.

9. The oscillating piston machine of claim 6, wherein said piston cage is perpendicular to said rotational axis, a bore in which said first piston and said second piston are held partially and so as to slide therein and which bounds said working chamber in a circumferential direction.

10. The oscillating piston machine of claim 1, wherein said angle is at least 90°.

11. The oscillating piston machine of claim 1, wherein said first piston and said second piston are mounted in a sliding fashion in a piston cage which is arranged in said housing concentrically with respect to said rotational axis so as to be rotatable about said rotational axis, wherein said piston cage is connected in a rotationally fixed fashion to said first piston and said second piston with respect to a rotating movement about said rotational axis, and wherein said piston cage also accommodates said third and fourth pistons.

12. The oscillating piston machine of claim 1, wherein a housing inner wall of said housing is spherical.

* * * * *